US005087930A

United States Patent [19]

Roy et al.

[11] Patent Number: 5,087,930

[45] Date of Patent: Feb. 11, 1992

[54] DROP-ON-DEMAND INK JET PRINT HEAD

[75] Inventors: Joy Roy; John S. Moore, both of Beaverton, Oreg.

[73] Assignee: Tektronix, Inc., Beaverton, Oreg.

[21] Appl. No.: 430,213

[22] Filed: Nov. 1, 1989

[51] Int. Cl.[5] ..... B41J 2/045

[52] U.S. Cl. ..... 346/140 R

[58] Field of Search ..... 346/140

[56] References Cited

U.S. PATENT DOCUMENTS

| | | | |
|---|---|---|---|
| 3,747,120 | 7/1973 | Stemme . | |
| 3,988,745 | 10/1976 | Sultan | 346/140 |
| 4,216,477 | 8/1980 | Matsuda et al. . | |
| 4,266,232 | 5/1981 | Juliana et al. . | |
| 4,312,010 | 1/1982 | Doring . | |
| 4,367,479 | 1/1983 | Bower | 346/140 |
| 4,367,480 | 1/1983 | Kotoh | 346/140 |
| 4,435,721 | 3/1984 | Tsuzuki et al. . | |
| 4,455,560 | 6/1984 | Louzil | 346/140 |
| 4,460,906 | 7/1984 | Kanayama . | |
| 4,521,788 | 6/1985 | Kimura et al. . | |
| 4,525,728 | 6/1985 | Koto . | |
| 4,528,575 | 7/1985 | Matsuda et al. | 346/140 |
| 4,584,590 | 4/1986 | Fischbeck et al. . | |
| 4,599,628 | 7/1986 | Doring et al. . | |
| 4,605,939 | 8/1986 | Hubbard | 346/140 |
| 4,635,079 | 1/1987 | Hubbard | 346/140 |
| 4,665,409 | 5/1987 | Behrens | 346/140 |
| 4,680,595 | 7/1987 | Cruz-Uribe et al. | 346/140 |
| 4,727,378 | 2/1988 | Le et al. . | |
| 4,835,554 | 5/1989 | Hoisington | 346/140 |
| 4,947,184 | 8/1990 | Moynihan | 346/140 X |

FOREIGN PATENT DOCUMENTS 172 1/1981 Japan .

*Primary Examiner*—Joseph W. Hartary

*Attorney, Agent, or Firm*—John D. Winkelman; Paul S. Angello

[57] ABSTRACT

An extremely compact ink jet print head has an array of closely spaced nozzles which are supplied from densely packed ink pressure chambers by way of offset channels. The ink supply inlets leading to the pressure chambers and the offset channels are designed to provide uniform operating characteristics to the ink jet nozzles of the array. To enhance the packing density of the pressure chambers, the ink supply channels leading to the pressure chambers and offset channels are positioned in planes between the pressure chambers and nozzles. An optional ink purging pathway is provided for purging bubbles and other contaminants from the chamber side of the nozzles. The ink jet print head may be assembled from plural plates with features in all but the nozzle defining plate being formed by photo-patterning and etching processes without requiring machining or other metal working.

10 Claims, 22 Drawing Sheets

DROP-ON-DEMAND INK JET PRINT HEAD

BACKGROUND OF THE INVENTION

The present invention relates to a drop-on-demand, or impulse, ink jet print head and in particular to a compact ink jet print head incorporating an array of ink jets each being driven by a separate driver.

Ink jet systems, and in particular drop-on-demand ink jet systems, are well known in the art. The principle behind an impulse ink jet is the displacement of an ink chamber and subsequent emission of ink droplets from the ink chamber through a nozzle. A driver mechanism is used to displace the ink in the ink chamber. The driver mechanism typically consists of a transducer (e.g., a piezoceramic material) bonded to a thin diaphragm. When a voltage is applied to a transducer, the transducer attempts to change its planar dimensions, but, because it is securely and rigidly attached to the diaphragm, bending occurs. This bending displaces ink in the ink chamber, causing the flow of ink both through an inlet from the ink supply to the ink chamber and through an outlet and passageway to a nozzle. In general, it is desirable to employ a geometry that permits multiple nozzles to be positioned in a densely packed array. However, the arrangement of ink chambers and coupling of ink chambers to associated nozzles is not a straight forward task, especially when compact ink jet array print heads are sought.

Some representative examples of the prior art will now be described.

Juliana, Jr., et al. U.S. Pat. No. 4,266,232 and Doring U.S. Pat. No. 4,312,010 each utilize a "reducer" section to converge channels leading from ink pressure chambers to nozzles to thereby achieve a more closely spaced array of nozzles. The use of a "reducer" section adds greatly to the thickness of an ink jet print head and adds to the complexity of manufacturing such print heads. In addition, the Doring patent discloses an array of nozzles with channels of differing lengths for coupling respective ink chambers to the associated nozzles. Because of the different length channels, ink jet print heads of this type will have varying jetting characteristics from the different nozzles. Costly drive circuitry which drives the various piezoelectric transducers differently to compensate for differences in channel length can be used, but uniform ink drop ejection from the varying nozzles is nevertheless difficult to achieve.

Stemme U.S. Pat. No. 3,747,120 (for example see FIG. 20) discloses still another ink jet print head design. In this design, respective rows of 2, 3 and 2 circular ink pressure chambers are arranged with staggered centers. Channels of unequal length couple the respective ink pressure chambers to a common ink chamber. The nozzles are in communication with this common ink chamber. In addition to other drawbacks, the use of a common ink chamber between the nozzles and channels allows acoustic cross talk between individual nozzles.

Doring, et al. U.S. Pat. No. 4,599,628 discloses a further ink jet print head structure having an array of nozzles. In this construction, a generally conically shaped ink pressure chamber couples the respective nozzles to a common ink supply. These pressure chambers are of circular cross section and are arranged in two parallel rows with the centers of the pressure chambers of one row being aligned with the centers of the pressure chambers of another row.

Another exemplary ink jet print head construction is shown in Cruz-Uribe, et al. U.S. Pat. No. 4,680,595 With reference to FIGS. 1, 3, 5 and 6 of this patent, two parallel rows of generally rectangular ink pressure chambers are shown with their centers aligned. Ink jet nozzles are each coupled to a respective associated ink pressure chamber. The central axis of each nozzle in this design extends normal to the plane containing the ink pressure chambers and intersects an extension portion of the ink pressure chamber. Also, ink is supplied to each of the chambers through a restrictive orifice that is carefully formed to match the nozzle orifice. In general, for ink of a particular viscosity and for a given drop ejection rate, a rectangular piezoceramic transducer having a greater surface area is required than in the case of a round or hexagonal piezoceramic transducer if the two types of jets are to be operated at the same drive voltage. In addition, due to the construction employed in this prior art ink jet array, the packing of ink chambers for a given size ink jet is limited.

Kanayama U.S. Pat. No. 4,460,906 describes an ink jet print head with a circular ink pressure chamber having an offset channel which connects the pressure chamber to a nozzle. In this ink jet print head, ink is ejected in a direction perpendicular to the plane of the ink pressure chambers. A pool of ink covers the outer surface of each nozzle through which the ink is jetted. Ink is supplied other than through an associated ink pressure chamber and thus this design is somewhat similar to Stemme U.S. Pat. No. 3,747,120 discussed above.

U.S. Pat. Nos. 4,216,477 to Matsuda, et al. and 4,525,728 to Koto are representative of ink jet designs in which ink is ejected parallel to, instead of perpendicular to, the plane of the ink pressure chambers. In general, prior art array ink jet print heads in which the nozzle axes are parallel to the plane of the transducers are relatively complex to manufacture. Connecting channels lead from individual ink pressure chambers to ink drop ejection nozzles. In the Koto patent, a row of rectangular transducers is mounted on one side of a substrate with another row of such transducers being mounted to the opposite side of the substrate. The transducers and associated nozzle openings on one side of the substrate are staggered with respect to those on the other side of the substrate to increase the packing density. In the Matsuda, et al. patent, each rectangular transducer is respectively coupled to an ink chamber which communicates through a passageway to a nozzle orifice. In at least some embodiments described in this patent, these passageways are of different length, depending upon the location of the transducer relative to its associated nozzle. Fishbeck, et al. U.S. Pat. No. 4,584,590 illustrates in FIGS. 3 and 4 still another ink jet print head array in which ink drops are ejected in a direction parallel to the plane of the rectangular transducers used to expand and contract the volume of an ink chamber. Other examples of constructions which eject ink droplets parallel to the plane of transducers or ink pressure chambers are shown in U.S. Pat. No. 4,435,721 of Tsuzuki; U.S. Pat. No. 4,528,575 to Matsuda; U.S. Pat. No. 4,521,788 of Kamura and D.E. U.S. Pat. No. 3,427,850 of Yamamuro.

Although there are a number of prior art ink jet print heads with an array of ink jets, a need exists for improved ink jet print heads of this type which are compact, relatively easy to manufacture, capable of high drop speed operation, and which are efficient.

SUMMARY OF THE INVENTION

A drop-on-demand ink jet print head receives ink from an ink supply and ejects drops of ink onto the print medium. The ink jet print head has a body which defines plural ink pressure chambers which are generally planar in the sense that they are much larger in cross-section than in depth. The ink pressure chambers each have an ink inlet and an ink outlet. The ink jet print head includes an array of proximately located nozzles and passages for coupling the ink pressure chambers to the nozzles. Each ink pressure chamber is coupled by an associated passage to an associated nozzle. Driver means are provided for displacing ink in each of the ink pressure chambers to thereby result in the ejection of ink drops from the nozzles. The nozzles are oriented to eject ink drops in a direction normal to the plane of the ink pressure chambers. The ink pressure chambers, passages and nozzles are designed to provide an extremely compact ink jet print head with closely spaced nozzles.

Also desirable is a print head that spans the minimum horizontal distance. For example, assume a portion of an ink print head prints black ink with 48 jets at 300 lines per inch, both horizontally and vertically. In this case, the ink jet print head would have a vertical row of 48 nozzles that spans 47/300 inch from the center of the first nozzle to the center of the last. In this configuration, each nozzle could address the left-most as well as the right-most address location on the paper without overscan. To the extent any horizontal displacement of the nozzles is present, overscan at both the left and right margins by at least the amount of this displacement is required in order that all of the locations of the print medium be addressed. Because the piezoelectric drivers required for jets of the type described here are many times larger than the inverse addressability, some horizontal displacement of the nozzles is necessary. The amount of displacement is dictated by the size of the piezoelectric drivers and their geometric arrangement. In accordance with one aspect of this invention, the ink jet print head is designed to minimize this horizontal displacement.

Furthermore, driver circuits are generally cheaper if they are integrated circuits rather than being made from individual components. Driver circuits are generally cheaper still if all of the drivers in one integrated circuit can be triggered at the same instant. Thus, if the nozzles of the print head cannot be arranged in a vertical line, then the horizontal displacement between one nozzle and any other should be some integer multiple of the inverse of the horizontal addressability if one of these inexpensive driver circuits is to be used. If more than one driver circuit is to be used, then this requirement is relaxed, but it is preferable that all of the nozzles driven by a single integrated circuit should still be spaced apart in the horizontal direction by an integer multiple of the horizontal addressability.

In accordance with one aspect of the present invention, the ink pressure chambers each have a geometric center and are arranged with their centers positioned in at least two parallel rows, each of the rows typically being comprised of at least four such chambers. In addition, the centers of the ink presure chambers in one row are offset or staggered from the centers of the ink pressure chambers in an adjacent row. In one specific example of the invention, the ink pressure chambers comprise at least four rows of ink pressure chambers, each row having at least four such chambers, and the chambers being arranged with their centers in an hexagonal array.

As another aspect of the present invention, the ink inlets to the pressure chambers and the ink outlets from the pressure chambers are diametrically or transversely opposed. This feature is present even in embodiments where there are four rows of pressure chambers and only one substantially horizontally oriented row of nozzles down the middle of the ink jet print head and wherein ink supply manifolds are positioned outside of the rows of pressure chambers. These transversely opposed inlets and outlets provide cross flushing of the pressure chambers during filling and purging as well as the largest distance between ink pressure chamber inlets and ink pressure chamber outlets for greatest acoustic isolation.

In accordance with a further aspect of the present invention, each of the ink pressure chambers are of a substantially equal transverse dimension in all directions in the place of the pressure chambers, with ink chambers of substantially circular or hexagonal cross section being examples.

As a further aspect of the present invention and to provide more uniform ink jet characteristics, the ink jet head passages from the ink pressure chambers to the nozzles are each preferably of the same lengths and cross-sectional dimensions so that the operating characteristics of each of the ink pressure chambers, associated passages, and nozzles are substantially the same.

As a still further aspect of the present invention, each of the nozzles preferably has a central axis which is normal to the plane containing the ink pressure chambers and which intersects the plane containing the ink pressure chambers at a location offset from ink pressure chambers in the plane.

As still another aspect of the present invention, the ink jet print head is preferably formed of a plurality of flat plates which are held together to form the ink jet print head and which define the various chambers, passages, channels, nozzles and manifolds of the ink jet print head.

As a further aspect of the invention, not all of the various features need be in a separate layer pattern. For example, the photoresist patterns that may be used as templates for chemically etching a metal layer could be different on each side of the metal layer. Thus, as a more specific example, the pattern for an ink manifold could be on one side of a metal sheet forming the layer while the pattern for a pressure chamber could be on the other side of the sheet and in registration front-to-back. Also, more than one layer may be used to define specific features of the ink jet print head. For example, an ink pressure chamber or an ink manifold may be formed in two or more layers that are stacked to register with one another.

As another aspect of the present invention, each of the passages from the ink pressure chambers to the nozzles extends in a first direction normal to the plane of the ink chambers for first distance, has an offset channel portion extending in a second direction in a plane parallel to the plane of the ink chambers for a second distance, and extends in a third direction parallel to the first direction for a third distance and to a nozzle. These offset channel portions enhance the dense packing of the ink pressure chambers and associated nozzles of the print head of this invention. Typically the extensions in the first and third directions are much smaller than the extension in the second direction. In particular, the extensions in these directions are less than a factor of two greater than the cross-sectional dimension of the passageway.

As a further aspect of the present invention, the ink pressure chambers are closely spaced and each has a geometric center with the center-to-center spacing of the ink chambers being a distance X. By closely spaced, it is meant that there is substantially no more material between adjacent ink pressure chambers than is necessary to make leak-free bonds between the laminations forming the ink jet print head. In addition, the nozzles each have a geometric center and are arranged in a row with their center-to-center spacing being approximately no greater than a distance of ¼ X. By minimizing the nozzle-to-nozzle spacing, including the spacing between nozzles of large arrays (for example, 16, 32, or 96 nozzles in specifically disclosed embodiments of the invention), high speed printing can be accomplished with minimal image distortion even when printing onto a print medium supported on and moved by a curved drum.

As another aspect of the present invention, the ink inlet of each ink chamber need not be restricted to a cross sectional dimension which approximately matches the dimension of the associated nozzles.

As a further aspect of the present invention, the ink jet print head defines at least one ink supply manifold and plural ink supply channels each coupling the ink supply manifold to an ink inlet of a respective ink pressure chamber. The ink supply channels and manifold are sized to provide acoustic isolation between the ink pressure chambers coupled to the manifold while still providing a sufficient flow of ink at the highest print rates at which the ink jet print head is to be operated. In the most preferred form of the invention, the ink supply channels are positioned in a plane or planes located between the ink pressure chambers and nozzles. Moreover, in this most preferred embodiment of the invention, each of the ink supply channels is of the same length and cross sectional dimension so that the operating characteristics of each of the ink pressure chambers and associated ink inlet and outlet passages and nozzles is substantially the same.

As still another aspect of the present invention, an optional ink purging mechanism may be provided. Such a mechanism may comprise a purging channel communicating from an associated passage adjacent a nozzle and to the exterior of the ink jet print head.

It is accordingly one object of the present invention to provide a compact ink jet print head with a closely spaced array of nozzles.

Still another object of the present invention is to provide an ink jet print head of this type which is relatively easy and cost-effective to manufacture.

A further object of the present invention is to provide an ink jet print head capable of efficient and stable operation at relatively high drop ejection rates.

Still another object of the present invention is to provide an ink jet print head having individual jets which have substantially identical ink drop ejection characteristics.

The present invention comprises an ink jet print head having the above features, directed to the above objects and exhibiting the above advantages taken either singly or in combination. These and other features, advantages and objects of the present invention will become more apparent with reference to the following description and drawings.

DETAILED DESCRIPTION OF THE PREFERRED EMBODIMENT

Figure 1:
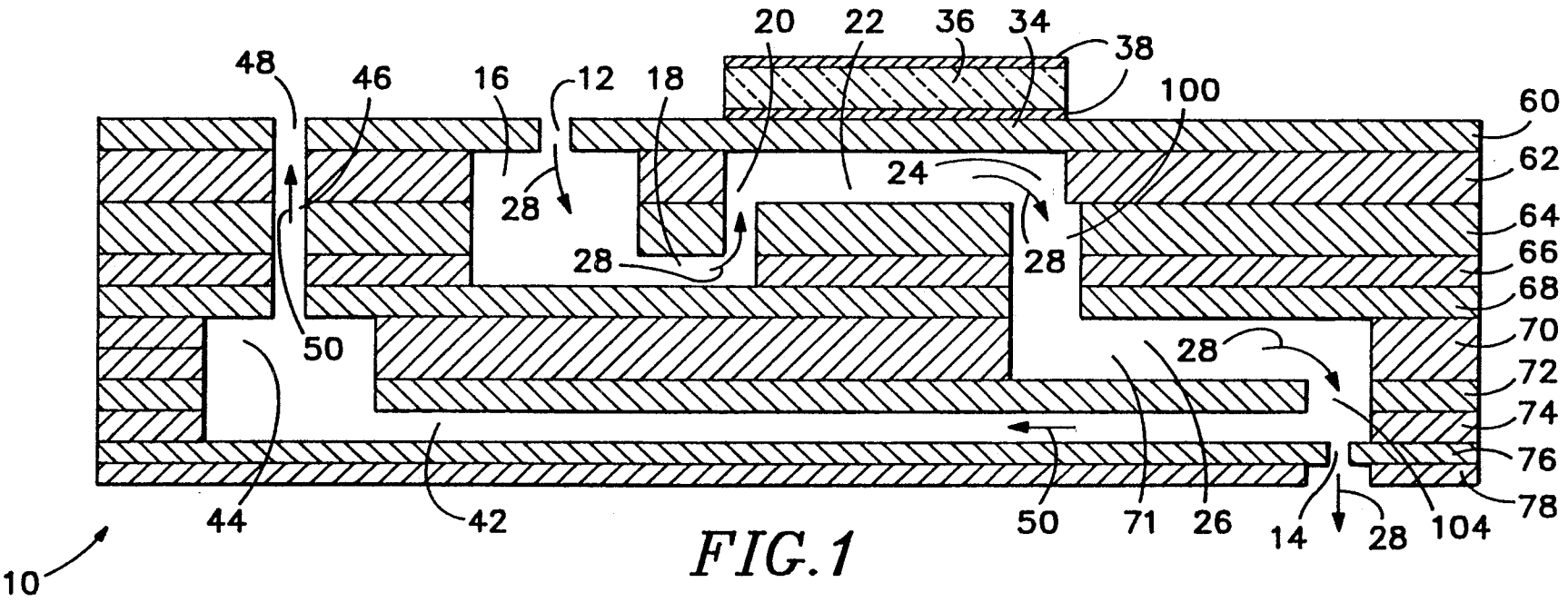
FIG. 1 is a diagrammatic cross-sectional view of a single ink jet of the type included in an array jet print head of the present invention.

The impetus for the print head of the present invention is a need for a drop-on-demand ink jet array print head that incorporates a compact array of ink drop-forming nozzles, each selectively driven by an associated driver, such as by a piezoceramic transducer mechanism. Consider an ink jet print head used in a typewriter-like print engine in which the print medium is advanced vertically on a curved surface past a print head which prints boustrophedon, that is, which shuttles back and forth and prints in both directions during shuttling. In such a case, it is desirable to provide a print head with an array of nozzles that span the minimum possible vertical distance so that the variation in distance to print medium for the various nozzles is at a minimum. The minimum vertical distance is the inverse of the addressability times one less than the number of jets that print a particular color. In the case of 48 jets that print black at an addressability of 300 lines/inch, this distance is 47/300 inch.

Also desirable is a print head that spans the minimum horizontal distance. In principle, then, the portion of the print head that prints black with 48 jets at 300 lines/inch both horizontally and vertically, for example, would have a vertical row of 48 nozzles that span 47/300 inch from the center of the first nozzle to the center of the last. In this configuration, each nozzle could address the left-most as well as the right-most address location on the paper without overscan. Any horizontal displacement of the nozzles requires overscan at both the left and right margins by at least the amount of this displacement in order that all of the locations of the print medium be addressed. This overscanning increases both the print time and the overall width of the printer. Therefore, to reduce these it is desirable to minimize the horizontal spacing between nozzles. Because the transverse dimensions of the pressure transducers (the electromechanical combination of the piezoceramic transducer diaphragm that bends into the pressure chamber) required for jets of the type described here are many times larger than the inverse addressability, some horizontal displacement of the nozzles is necessary, the amount being dictated by the size of the transducers and their geometric arrangement. The objective is to minimize this displacement.

One approach for accomplishing the objective of minimizing the horizontal spacing of nozzles is to allow no features within the boundaries of the array of ink pressure chambers or pressure transducers. All other features are either outside the boundary of the array of these transducers or pressure chambers if they are in the plane of these components or they are placed in planes above (further from the nozzles) or below (closer to the nozzles) these components. For example, all electrical connections to the transducers can be made in a plane above the pressure transducers and all inlet passages, offset channel passages, outlet passages, and nozzles can be in planes below the ink pressure chambers and pressure transducers. Wherever two of these types of features would interfere with each other geometrically if they were placed in the same plane, they are placed in different planes from each other so that the horizontal displacement of the nozzles is controlled only by how closely the pressure transducers or pressure chambers can be positioned. For example, the inlet passages can be in a different plane than the offset channel passages and the offset channel passages can be in a different plane than the outlet passages. Thus, to minimize the horizontal and vertical dimensions of the array of nozzles, extra layers are added which increase the thickness of the print head.

Integrated electronic driver circuits are generally less expensive than those made from individual components. They are generally less expensive yet if all of the drivers in the integrated circuit can be triggered at the same instant. Thus, if the nozzles of the print head cannot be arranged in a vertical line, then the horizontal displacement between one nozzle and any other should be some integer multiple of the inverse of the horizontal addressability if inexpensive driver circuits are to be used. If more than one driver circuit is to be used, then this requirement is relaxed, but all of the nozzles driven by a single integrated circuit should still be spaced apart in the horizontal direction by integer multiples of the horizontal addressability.

Also desirable is a compact print head that has low drive voltage requirements, that is capable of operating at a high ink drop election rate, that is relatively inexpensive to fabricate, and that can print multiple colors of ink. In general, a print head that combines all of these characteristics is highly desirable, although each of these characteristics is individually desirable and contributes to the uniqueness of the ink jet print head of the present invention.

With reference to FIG. 1, one form of ink jet print head in accordance with the invention has a body 10 which defines an ink inlet 12 through which ink is delivered to the ink jet print head. The body also defines an ink drop forming orifice outlet or nozzle 14 together with an ink flow path from the ink inlet 12 to the nozzle. In general, the ink jet print head of the present invention preferably includes an array of nozzles 14 which are proximately disposed, that is closely spaced from one another, for use in printing drops of ink onto print medium (not shown).

Ink entering the ink inlet 12 flows into an ink supply manifold 16. A typical ink jet print head has at least four such manifolds for receiving, respectively, black, cyan, magenta, and yellow ink for use in black plus three color subtraction printing. However, the number of such manifolds may be varied depending upon whether a printer is designed to print solely in black ink or with less than a full range of color. From ink supply manifold 16, ink flows through an ink supply channel 18, through an ink inlet 20 and into an ink pressure chamber 22. Ink leaves the pressure chamber 22 by way of an ink pressure chamber outlet 24 and flows through an ink passage 26 to the nozzle 14 from which ink drops are ejected. Arrows 28 diagram this ink flow path.

The ink pressure chamber 22 is bounded on one side by a flexible diaphragm 34. The pressure transducer in this case a piezoelectric ceramic disc 36 secured to the diaphragm 34, as by epoxy, overlays the ink pressure chamber 22. In a conventional manner, the piezoceramic disc 36 has metal film layers 38 to which an electronic circuit driver, not shown, is electrically connected. Although other forms of pressure transducers may be used, the illustrated transducer is operated in its bending mode. That is, when a voltage is applied across the piezoceramic disc, the disc attempts to change its dimensions. However, because it is securely and rigidly attached to the diaphragm, bending occurs. This bending displaces ink in the ink chamber 22, causing the outward flow of ink through the passage 26 and to the nozzle. Refill of the ink chamber 22 following the ejection of an ink drop can be augmented by reverse bending of the transducer 36.

In addition to the main ink flow path 28 described above, an optional ink outlet or purging channel 42 is also defined by the ink chamber body 10. The purging channel 42 is coupled to the ink passage 26 at a location adjacent to, but interiorly of, the nozzle 14. The purging channel communicates from passage 26 to an outlet or purging manifold 44 which is connected by an outlet passage 46 to a purging outlet port 48. The manifold 44 is typically connected by similar purging channels 42 to the passages associated with multiple nozzles. During a purging operation, as described more fully below, ink flows in a direction indicated by arrows 50, through purging channel 42, manifold 44 and purging passage 46.

To facilitate manufacture of the ink jet print head of the present invention, the body 10 is preferably formed of plural laminated plates or sheets, such as of stainless steel. These sheets are stacked in a superposed relationship. In the illustrated FIG. 1 embodiment of the present invention, these sheets or plates include a diaphragm plate 60, which forms the diaphragm and also defines the ink inlet 12 and purging outlet 48; an ink pressure chamber plate 62, which defines the ink pressure chamber 22, a portion of the ink supply manifold, and a portion of the purging passage 48; a separator plate 64, which defines a portion of the ink passage 26, bounds one side of the ink pressure chamber 22, defines the inlet 20 and outlet 24 to the ink pressure chamber, defines a portion of the ink supply manifold 16 and also defines a portion of the purging passage 46; an ink inlet plate 66, which defines a portion of the passage 26, the inlet channel 18, and a portion of the purging passage 46; another separator plate 68 which defines portions of the passages 26 and 46; an offset channel plate 70 which defines a major or offset portion 71 of the passage 26 and a portion of the purging manifold 44; a separator plate 72 which defines portions of the passage 26 and purging manifold 44; an outlet plate 74 which defines the purging channel 42 and a portion of the purging manifold; a nozzle plate 76 which defines the nozzles 14 of the array; and an optional guard plate 78 which reinforces the nozzle plate and minimizes the possibility of scratching or other damage to the nozzle plate.

More or fewer plates than illustrated may be used to define the various ink flow passageways, manifolds and pressure chambers of the ink jet print head of the present invention. For example, multiple plates may be used to define an ink pressure chamber instead of the single plate illustrated in FIG. 1. Also, not all of the various features need be in separate sheets or layers of metal. For example, patterns in the photoresist that are used as templates for chemically etching the metal (if chemical etching is used in manufacturing) could be different on each side of a metal sheet. Thus, as a more specific example, the pattern for the ink inlet passage could be on one side of the metal sheet while the pattern for the pressure chamber could be on the other side and in registration front-to-back. Thus, with carefully controlled etching, separate ink inlet passage and pressure chamber containing layers could be combined into one common layer.

To minimize fabrication costs, all of the metal layers of the ink jet print head, except the nozzle plate 76, are designed so that they may be fabricated using relatively inexpensive conventional photo-patterning and etching processes in metal sheet stock. Machining or other metal working processes are not required. The nozzle plate 76 has been made successfully using any number of varying processes, including electroforming from a sulfumate nickel bath, micro-electric discharge machining in three hundred series stainless steel, and punching three hundred series stainless steel, the last two approaches being used in concert with photo-patterning and etching all of the features of the nozzle plate except the nozzles themselves. Another suitable approach is to punch the nozzles and to use a standard blanking process to form the rest of the features in this plate. The print head of the present invention is designed so that layer-to-layer alignment is not critical. That is, typical tolerances that can be held in a chemical etching process are adequate.

The various layers forming the ink jet print head of the present invention may be aligned and bonded in any suitable manner, including by the use of suitable mechanical fasteners. However, a preferred approach for bonding the metal layers is described in U.S. patent application Ser. No. 07/239,358, filed Sept. 1, 1988, by Anderson, et al., and entitled "Manufacture of Ink Jet Print heads by Diffusion Bonding and Brazing" now U.S. Pat. No. 4,883,219. This patent application is incorporated herein in its entirety by reference. In accordance with one approach described in this patent application, the various metal layers are plated with a layer of from one-eighth to one-quarter micron thick metal that diffusion bonds well to itself, that is also a good brazing material, and that can be reliably plated onto the stainless steel layers of the ink jet print head, or to other materials forming the ink jet print head in the event stainless steel is not used. Gold, for example, can be plated readily onto stainless steel and bonds and brazes particularly well. After plating, the various layers are stacked in sequence on a simple two-pin alignment fixture that also may serve as a platen of the diffusion bonding fixture. The stacks of parts are (a) diffusion bonded at 400°-500° C., a temperature range which minimizes thermal distortions in the various layers; (b) removed from the diffusion bonding fixtures; (c) inserted without fixturing into a hydrogen-atmosphere brazing furnace; and (d) brazed.

This bonding process is hermetic, produces high strength bonds between the parts, leaves no visible fillets to plug the small channels in the print head, does not distort the features of the print head, and yields an extremely high percentage of satisfactory print heads, approaching one hundred percent. This manufacturing process can be implemented with standard plating equipment, standard furnaces, and simple diffusion bonding fixtures, and can take less than three hours from start to finish for the complete bonding cycle, with many ink jet print heads being simultaneously manufactured. In addition, the plated metal is so thin that essentially all of it diffuses into the stainless steel during the brazing step so that none of it is left to interact with the ink, either to be attacked chemically or by electrolysis. Therefore, plating materials, such as copper, which are readily attacked by some inks may be used in this bonding process.

Figure 2A:
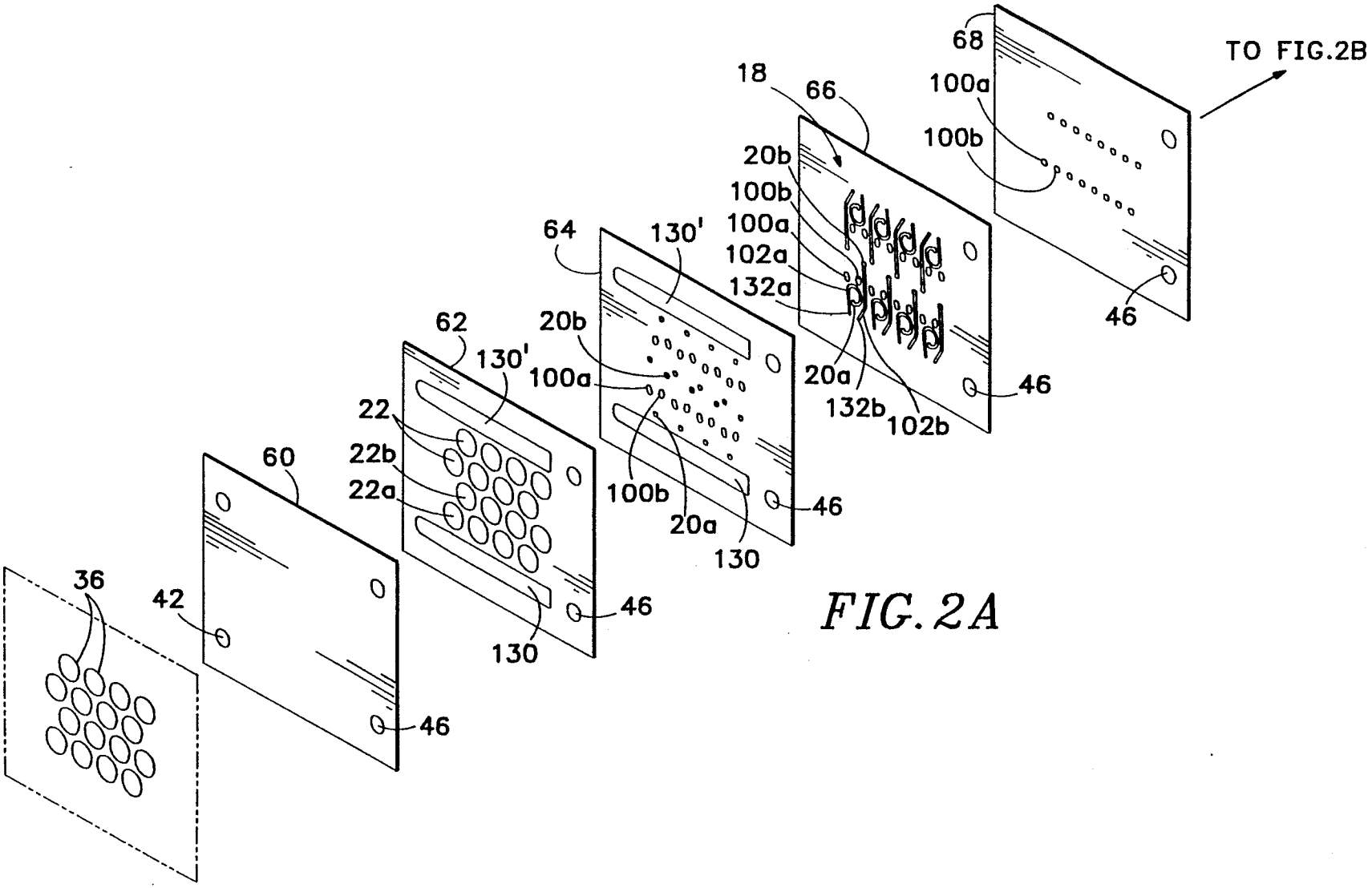
FIGS. 2A and 2B are an exploded perspective view of the various layers that are used in the construction of one embodiment of an array ink jet print head in accordance with the present invention which includes sixteen individual jets.
Figure 2B:
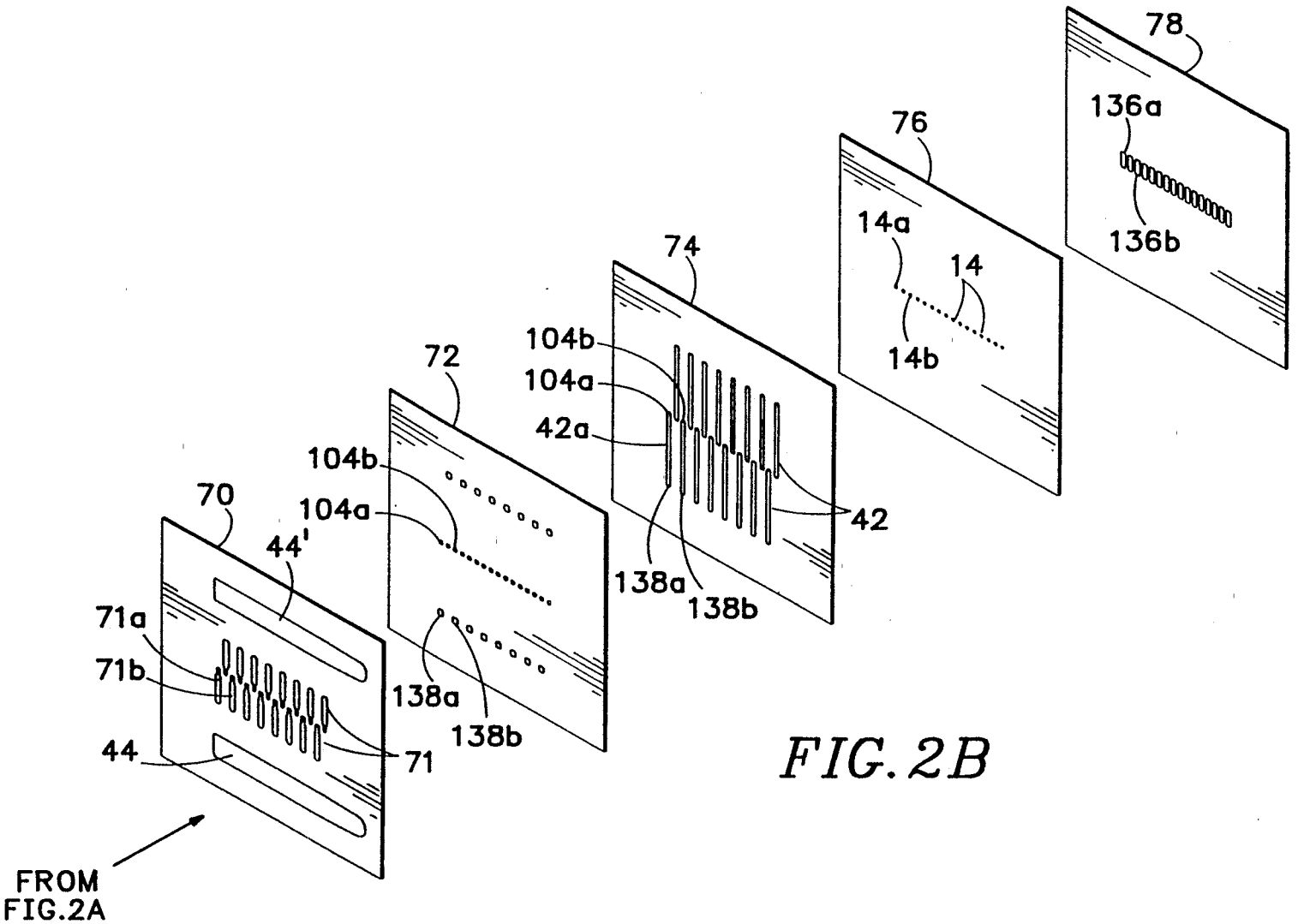

The electromechanical transducer mechanism 34, 36 selected for the ink jet print heads of the present invention can comprise metallized piezoceramic discs bonded with epoxy to the metal diaphragm plate 60 with each of the discs centered over a respective ink pressure chamber 22, such as shown in FIG. 2. This latter figure is an exploded schematic perspective view of the various layers 60–78 used in the construction of an array jet print head that contains sixteen individual jets or print nozzles. For this type of transducer, a substantially circular shape has the highest electromechanical efficiency. This electromechanical efficiency refers to the volume displacement for a given area of the piezoceramic element. Thus, transducers of this type are more efficient than rectangular type, bending mode transducers.

To provide an extremely compact and easily manufactured ink jet print head, the various pressure chambers 22 (FIG. 2) are generally substantially planar. That is, the pressure chambers 22 are much larger in transverse cross-sectional dimension than in depth, which results in a higher pressure for a given displacement of the transducer into the volume of the pressure chamber. Moreover, all of the ink jet pressure chambers of the ink jet print head of the present invention are preferably, although not necessarily, located in the same plane or at the same depth within the ink jet print head. This plane is defined by the plane of one or more plates 62 (FIGS. 1 and 2) used to define these pressure chambers.

In order to achieve an extremely high packing density, the ink pressure chambers 22 are arranged in at least two parallel rows with their geometric centers offset or staggered from one another. Also, the pressure chambers are typically separated by very little sheet material. In general, only enough sheet material remains between the pressure chambers as is required to accomplish reliable (leak-free) bonding of the ink pressure defining layers to adjacent layers. As shown in FIGS. 2–7, a preferred arrangement comprises at least four parallel rows of pressure chambers 22 with the centers of the chambers of one row offset or staggered from the centers of the chambers of an adjacent row. In particular, with the circular pressure chambers as shown in FIG. 2, the four parallel rows or pressure chambers are offset so that their geometric centers, if interconnected by lines, would form an hexagonal array. The centers of the chambers may be located in a grid or array of irregular hexagons, but the most compact configuration is acheived with a grid of regular hexagons. This grid may be extended indefinitely in any direction to increase the number of ink pressure chambers and nozzles in a particular ink jet print head. In general, for reasons of efficient operation, it is preferable that the pressure chambers have a transverse cross-sectional dimension that is substantially equal in all directions. Hence, substiantially circular pressure chambers have been found to be extremely efficient. However, other configurations such as pressure chambers having a substantially hexagonal cross section, and thus having substantially equal transverse cross-sectional dimensions in all directions, would also be extremely efficient. Pressure chambers having other cross-sectional dimensions may also be used, but those with substantially the same uniform transverse cross-sectional dimension in all directions are the most preferred.

The piezoceramic disks 36 are typically no more than 0.010 inch thick, but they may be either thicker or thinner. While ideally these disks would be substantially circular to conform to the shape of the substantially circular ink pressure chambers, little increase in drive voltage is required if these disks are made hexagonal. Therefore, the disks can be cut from a large slab of material using, for example, a circular saw. The diameter of the inscribed circle of these hexagonal piezoceramic disks 36 is typically several thousanths of an inch less than the diameter of the associated pressure chamber 22 while the circumscribed circle of these disks is several thousanths of an inch larger. The diaphragm layer 60 is typically no more than 0.004 inch thick.

As previously mentioned and with reference to FIG. 1, passages 26 are provided to connect each of the pressure chambers 22 to its associated nozzle. In general, each of these passages 26 is comprised of a first section 100 extending in a direction normal to its associated pressure chamber 22 for a first distance, a second offset channel section 71 extending in a second direction parallel to the plane of the associated ink jet chamber 22 for a second distance, and a third section 104 extending normal to the second direction and to the associated ink jet nozzle 14. The offset channel portion 71 of the passage 26 enables the alignment of nozzles 14 in one or more rows (see FIGS. 2, 4, 6 and 7) with the center-to-center spacing of the nozzles being much closer together than the center-to-center spacing of the associated pressure chambers.

The offset channel sections 71 comprise a major portion of the passages 26. In addition, the passages, and in particular the offset channel portions, are located between the ink jet pressure chambers and associated nozzles. Preferably, the passages 26 associated with the pressure chambers and nozzles are of the same cross-sectional dimension and length. Consequently, and assuming the inlet channels to the pressure chambers (see below) are of similar cross-sectional dimension and length, all of the jets have the same resonance characteristics and can be driven with identical wave forms to provide substantially identical ink drop jetting characteristics from the various nozzles. Furthermore, the offset channel portions 71 are typically positioned in a single common plane so as to minimize the thickness and thus the weight and cost of the ink jet print head.

In FIGS. 2–8 and 15, offset channel sections, some of which are indicated as 71, are illustrated making the connections between the passage portions 100 and 104. When the center-to-center spacing of the hexagonally arranged pressure chambers is 0.135 inch, then the distance from the center of the radius at one end of the offset channel sections to the center of the radius at the other end is 0.116 inch. That is, from the geometry of an equilateral triangle, the offset channel length is equal to the ink pressure chamber center-to-center spacing multiplied by ($\sqrt{3}/2$). In addition, offset channels 71 are typically 0.015 inch wide at the end adjacent to the nozzle and 0.024 inch wide at the other end, although the widths may be varied. For example, widths at this other end ranging from 0.020 to 0.036 inch have been successfully tested. The typical thickness of the offset channels is 0.20 inch and may be achieved, for example, by superimposing two identical layers.

Figure 3:
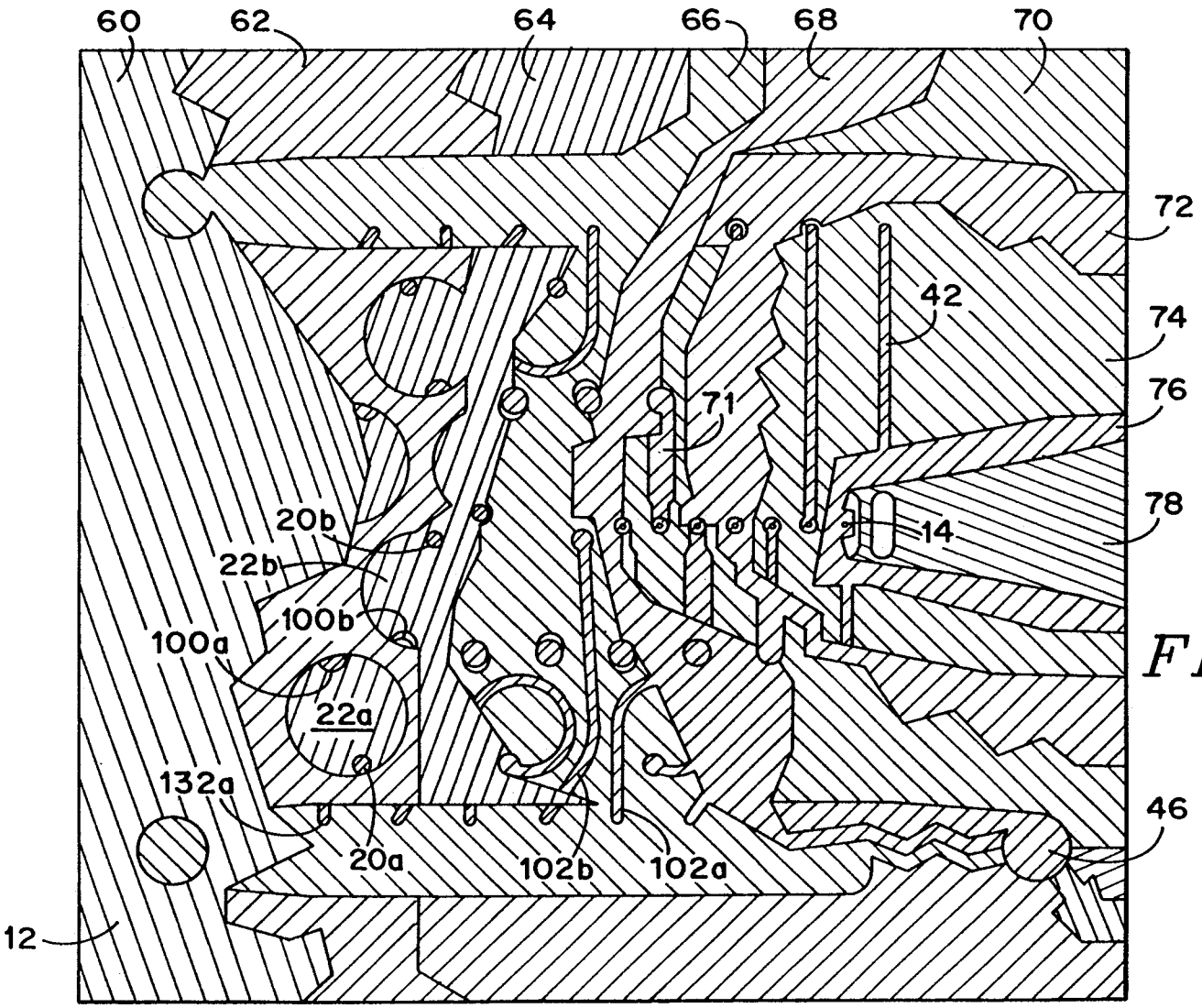
FIG. 3 is a partially broken away schematic view through the various layers of the ink jet print head of FIG. 2 and showing the layer-to-layer alignment of the various features of this embodiment of the ink jet print head.

Again, with reference to FIGS. 1 through 3, the nozzles 14 have a central axis which is generally normal to the plane of plate 62 and thus to the plane of the associated ink pressure chambers 22. In addition, the central axes of these nozzles, if extended to intersect plate 62, are offset from and do not intersect the associated pressure chambers. In the ink jet print head shown in FIGS. 2 and 3, the nozzles 14 are arranged in a single row, which preferrably but not necessarily is a straight line row, while the pressure chambers 22 coupled to these nozzles are arranged in four rows. In addition, a typical transverse dimension of the pressure chambers is 0.110 inch with the hexagonal array of pressure chambers being set with a 0.135 inch center-to-center spacing. Thus, the pressure chambers are closely spaced with only a minimal amount of plate material between them necessary for bonding purposes. Nozzle diameters ranging from 35 to 85 microns have been used successfully, although the nozzle dimensions are not limited to this range. For printing with aqueous based inks at 300 dots per inch, the preferred nozzle diameter is about 40 microns. For printing with hot melt or phase change inks at 300 dots per inch, because of the limited spreading of the ink drops are the print medium, the preferred nozzle diameter is about 75 microns. In both of these instances, a preferred thickness of the nozzle plate is about 63 to 75 microns or 0.0025 to 0.0030 inch.

Figure 4A:
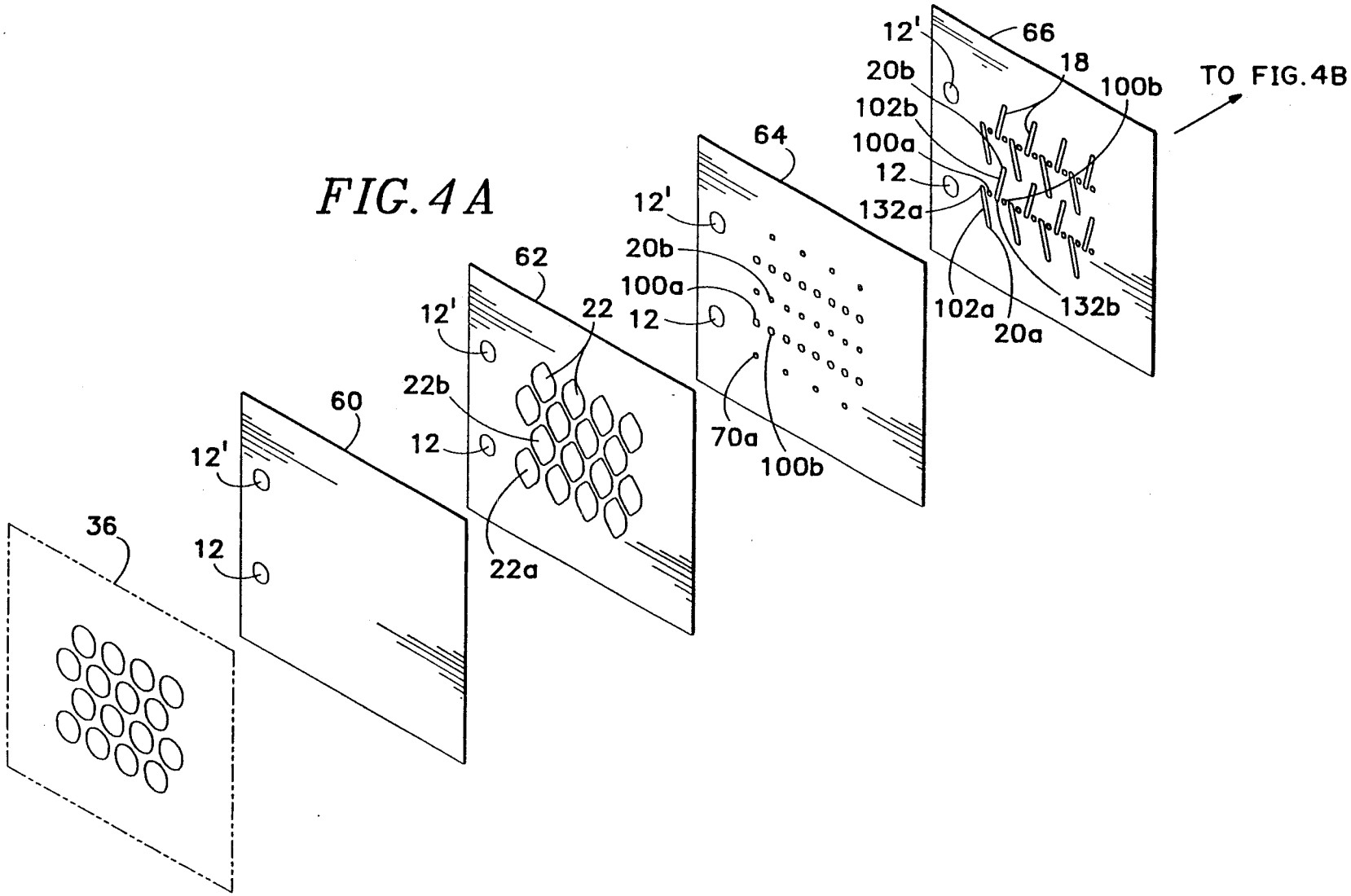
FIGS. 4A and 4B are an exploded perspective view of the various layers forming an array ink jet print head of another embodiment of the invention having sixteen individual ink jets, which eliminates the optional purging features of the embodiment of FIGS. 1–3, and which positions ink supply manifolds between the ink pressure chambers and nozzles.
Figure 4B:
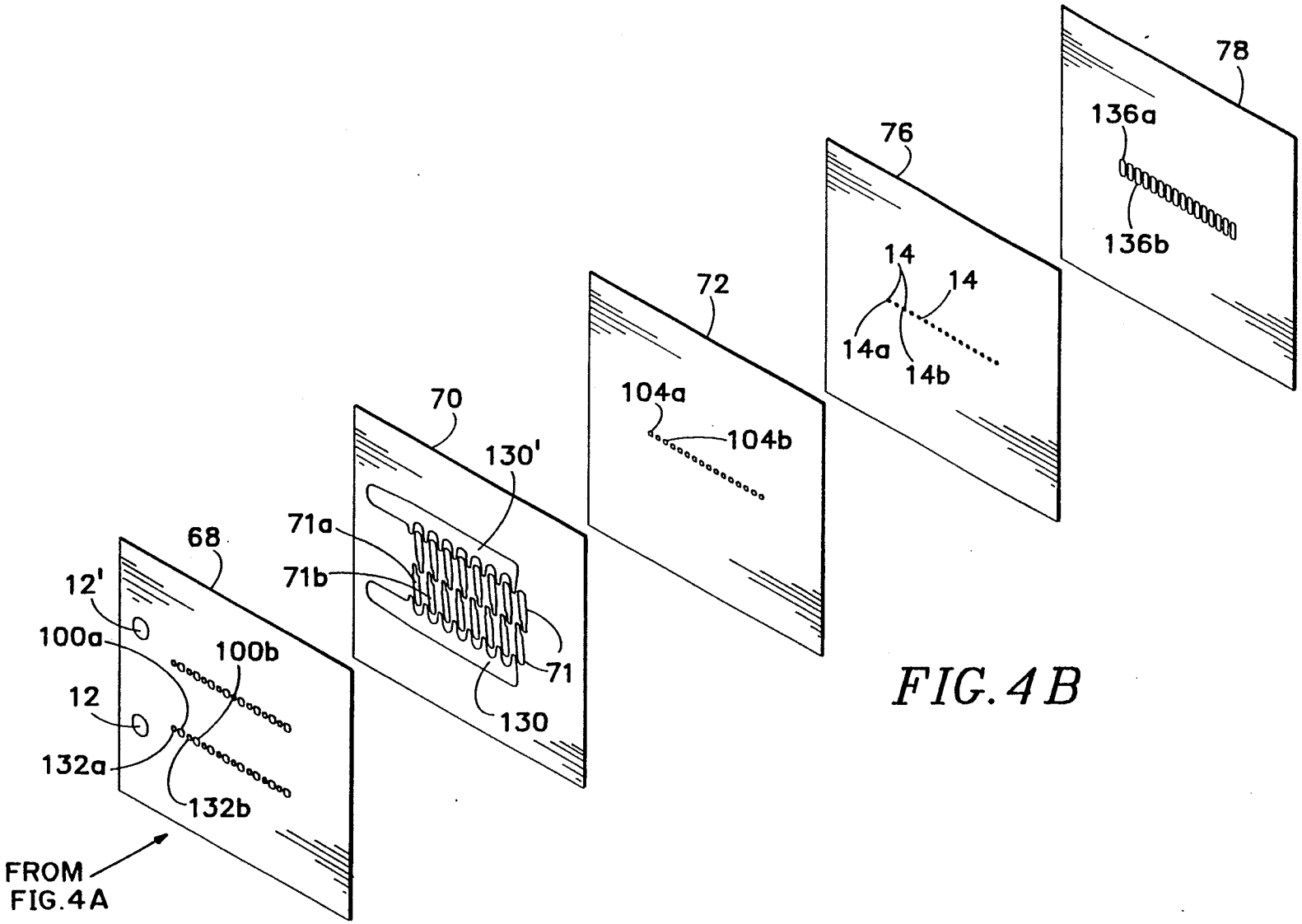

In addition, with the construction illustrated in FIGS. 2 and 4, and in particular with the offset channels as shown, the center-to-center spacing of the nozzles during operation is about 0.0335 inch. At this spacing, if the line of nozzles is rotated from horizontal through an angle whose arctangent is 1/10, (see FIG. 8), then the vertical distance between adjacent nozzles will be just 1/300 inch and the corresponding horizontal spacing will be 10/300 inch. At these horizontal and vertical spacings, the print head is set to print at an addressability of 300 dots per inch in both the horizontal and vertical directions.

Assume that an ink jet print head has the above described geometrical arrangement of pressure chambers and nozzles. Also assume that the inverse vertical addressability =v; the inverse horizontal addressability =h; and the number of horizontal addresses between nozzles =n. In this case, and with reference to FIG. 7, the spacing s, between nozzles, the center-to-center spacing C between pressure chambers and the distance L between rows of pressure chambers are expressed by the following relationships:

$$s = \sqrt{v^2 + (nh)^2}$$

$$C = 4s = 4\sqrt{v^2 + (nh)^2}$$

$$L = \frac{\sqrt{3}}{2} C = 2\sqrt{3}\ \sqrt{v^2 + (nh)^2}$$

As a more specific example, if v=h=1/300 inch, then the table below sets forth selected values of s, C, and L for various n. Other values can be computed in the same manner.

TABLE

| n | s (inch) | C (inch) | L (inch) |
|---|---|---|---|
| 10 | .0335 | .1340 | .1160 |
| 9 | .0302 | .1207 | .1046 |
| 8 | .0269 | .1075 | .0931 |
| 7 | .0236 | .0943 | .0816 |
| 6 | .0203 | .0811 | .0702 |

This same calculation follows for any integer multiple of the inverse horizontal addressability of the nozzle-to-nozzle horizontal spacing.

Figure 7:
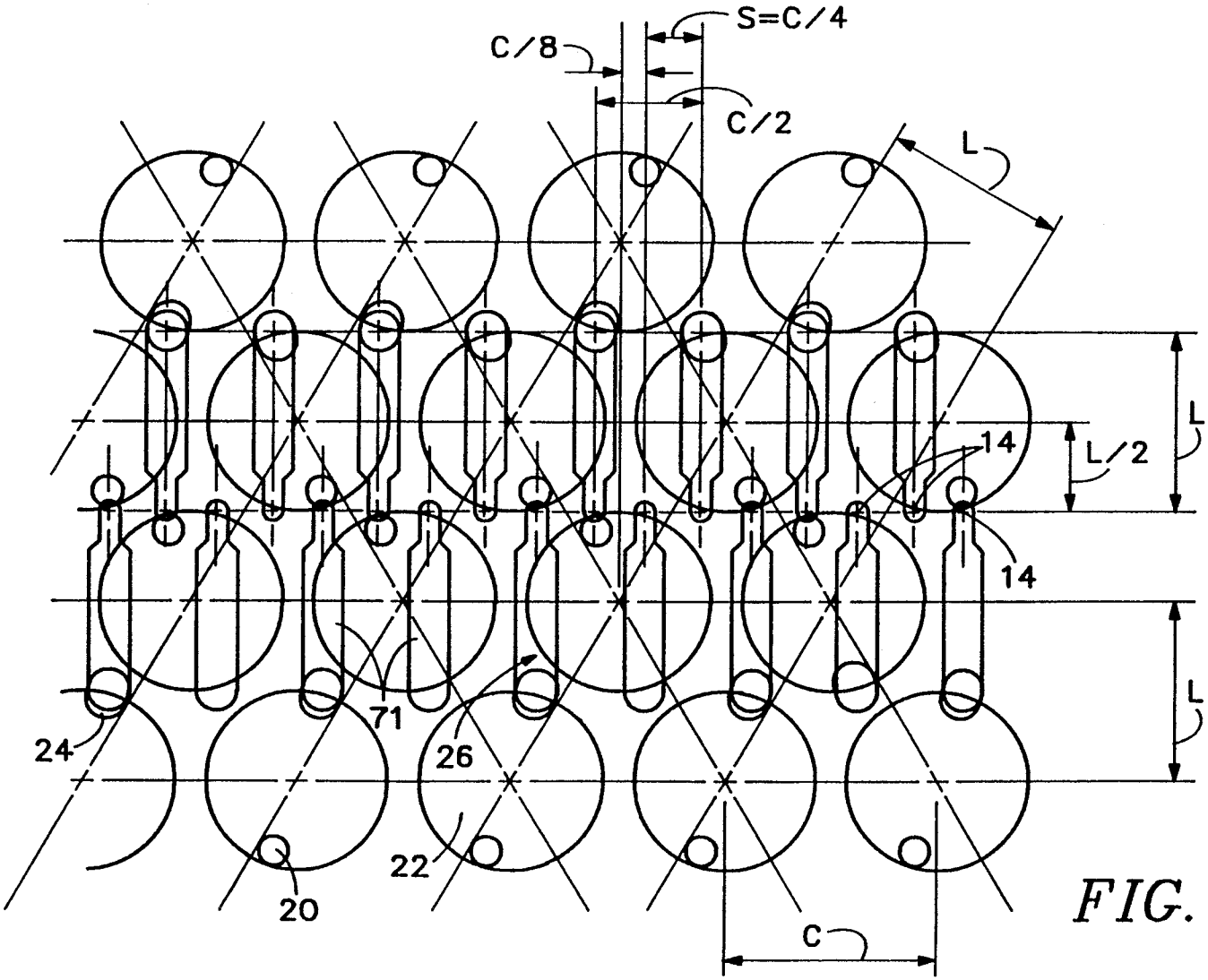
FIG. 7 is a schematic illustration of overlayed ink pressure chambers, ink inlet and outlet passageways and offset channels to more clearly illustrate the transverse spacing of inlet and outlet openings and the orientation of nozzles to the ink pressure chambers.

FIG. 7 also illustrates the arrangement wherein the ink inlets 20 to the pressure chambers 22 and the ink outlets 24 from the pressure chambers are diametrically opposed even though there are four rows of pressure chambers, only one row of nozzles 14 along the center of the ink jet print head, and ink supply manifolds (FIGS. 2 and 8) outside of the boundaries of the ink pressure chamber array. These diametrically opposed inlets and outlets provide cross flushing of the pressure chambers during filling and purging to facilitate the sweeping of bubbles and contaminants from the pressure chambers. This arrangement of inlets and outlets also provides the largest distance between inlets and outlets for enhanced acoustic isolation. In addition, the outlets are closer in the fluid path, that is, fluidically closer, to the nozzles than the inlets.

Thus, with the illustrated construction, the nozzles may be arranged with center-to-center spacings which are much closer than the center-to-center spacings of closely spaced and associated pressure chambers. For example, assuming the center-to-center spacing of the pressure chambers is X, the center-to-center spacing of the associated nozzles is preferrably one-fourth X as indicated by the dimensions set forth above. For purposes of symmetry it is preferrable that the nozzle-to-nozzle spacing in a row of nozzles is the inverse of the number of rows of ink pressure chambers supplying the row of nozzles. Thus, for example, if there were six rows of ink pressure chambers supplying one row of nozzles, preferrably the nozzle-to-nozzle spacing would be one-sixth of the center-to-center spacing of these ink pressure chambers. Consequently, an extremely compact ink jet print head is provided with closely spaced nozzles. As a more specific example of the compact nature of ink jet print heads of the present invention, the 96 nozzle array jet of FIG. 7 is about 3.8 inches long by 1.3 inch wide by 0.07 inch thick.

FIGS. 2 and 3 also show ink outlet or purging channels for connecting the ink outlet manifolds 44 (FIG. 1) to the nozzles 14. Typically, these optional channels and manifolds are only used during initial jet filling and during purging to remove air bubbles. A valve, not shown, is used to close the purging outlet 48 and thus the purging flow path 50 when not being used. Le, et al., U.S. Pat. No. 4,727,378 hereby incorporated by reference, discloses in greater detail the use of such a purging outlet. In general, the purging channel and manifold provides a path for ink through each ink jet in addition to the path through small nozzles 14. Consequently, bubbles and other contaminants may be flushed from the ink jets without being forced through the nozzles. These optional ink outlet channels and manifolds have not been observed to have any detrimental effect on the performance of the ink jet print heads of the present invention. Although variable, typical dimensions of channel 42 are 0.300 inch long by 0.010 inch wide by 0.004 inch thick. Elimination of the purging channels and outlets reduces the thickness of the ink jet print head of the present design by eliminating the plates used in defining these features of the print head.

With further reference to FIGS. 1 through 3, the illustrated ink supply channels 18 are defined by a plate 66 located in a plane between the ink pressure chambers 22 and the ink nozzles 14. Assume an ink jet print head construction has four rows of pressure chambers. In this case and to eliminate the need for ink supply inlets to the two inner rows of pressure chambers from passing between the pressure chambers of the outer two rows of jets, which would thereby increase the required spacing between the pressure chambers, ink supply inlets pass to the pressure chambers in a plane located beneath the pressure chambers. That is, the supply inlets extend from the exterior of the ink jet to a location in a plane between the pressure chambers and nozzles. The ink supply channels then extend to locations in alignment with the respective pressure chambers and are coupled thereto from the underside of the pressure chambers.

To provide fluid impedance of inlet channels to the inner rows of pressure chambers that is the same as the fluid impedance of the inlet channels to the outer two rows of pressure channels, the inlet channels can be made in two different configurations that have the same cross section and same overall length (See configurations **102*a* and 102*b* in FIGS. 2, 3, 8 and 13). The length of the inlet channels and their cross sectional area determine their characteristic impedance, which is chosen to provide the desired performance of these jets and which avoids the use of small orifices or nozzles at the inlet 20** to the pressure chambers. Typical inlet channel dimensions are 0.275 inch long by 0.010 inch wide and vary from 0.004 inch thick to 0.016 inch thick, depending upon the viscosity of the ink. Ink viscosity typically varies from about one centipoise for aqueous inks to about ten to fifteen centipoise for hot melt inks. The important factor is to size the inlets so as to supply sufficient ink for operation at the desired maximum ink jet printing rate while still providing satisfactory acoustic isolation of the ink pressure chambers.

Figure 5:
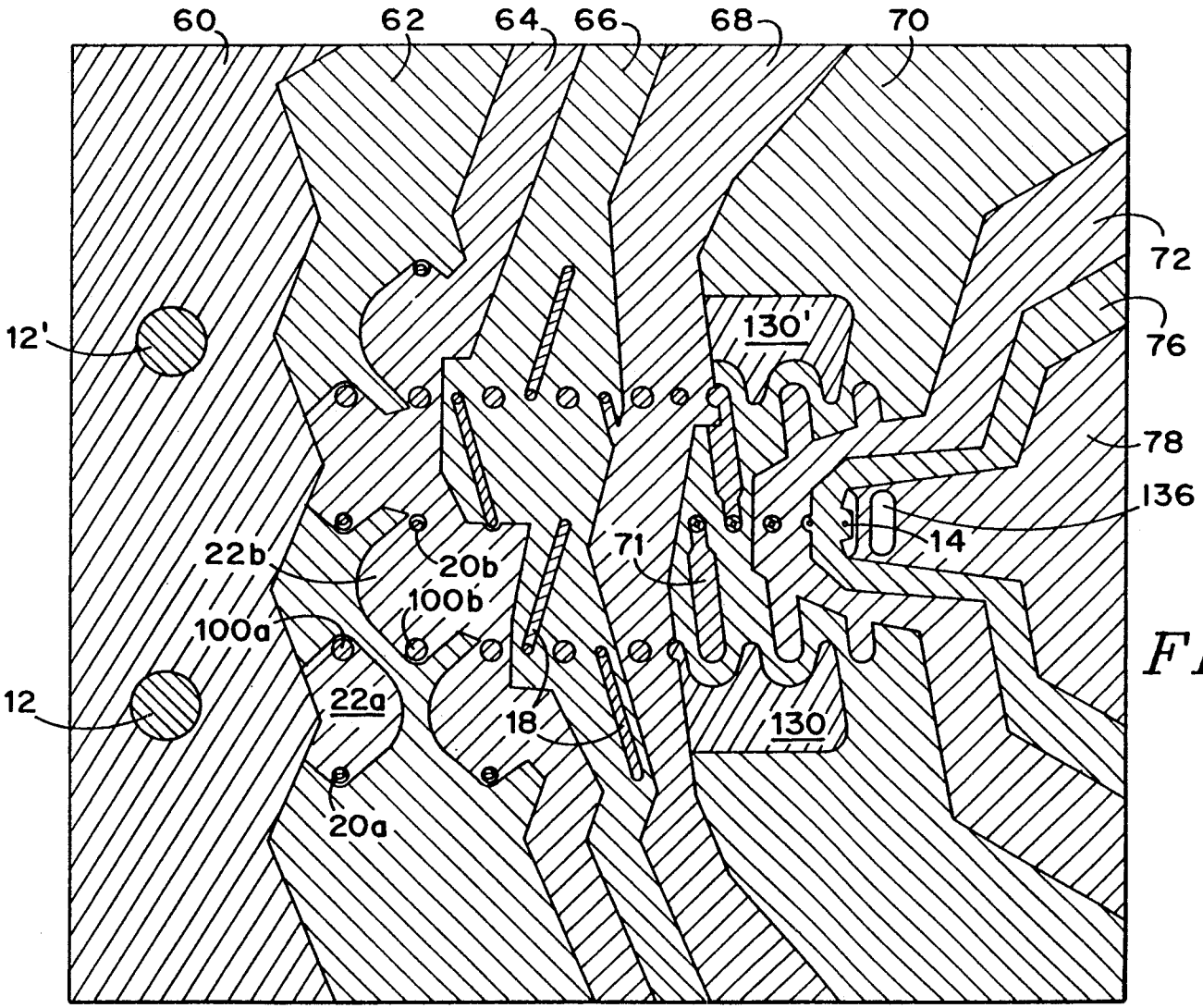
FIG. 5 is a partially broken away schematic view through the various layers of the ink jet print head of FIG. 4 and showing the layer-to-layer alignment of the various features of this embodiment of the ink jet print head.
Figure 6A:
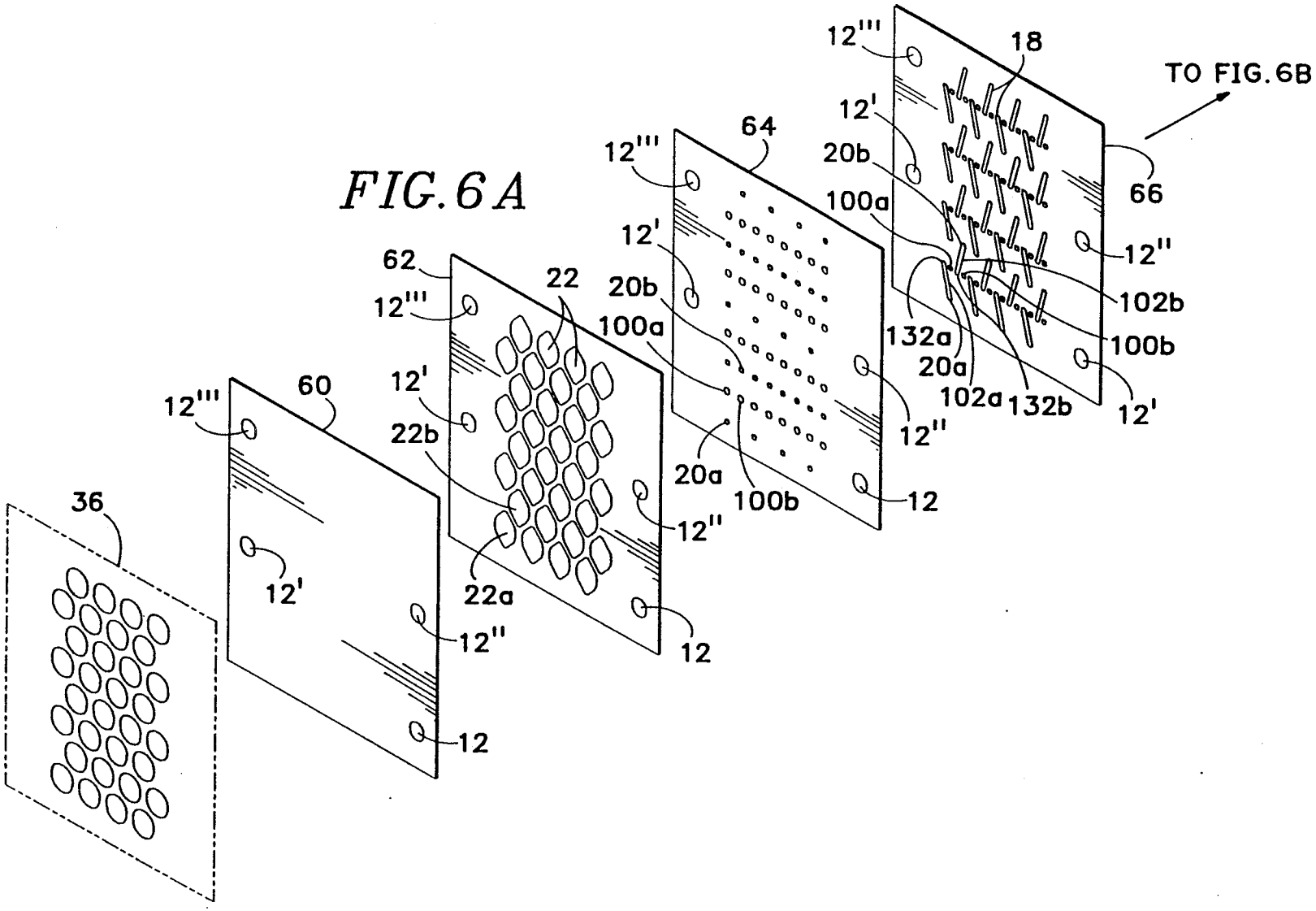
FIGS. 6A and 6B are a perspective view of another form of ink jet print head in accordance with the present invention having an array comprising two parallel rows of sixteen nozzles.
Figure 6B:
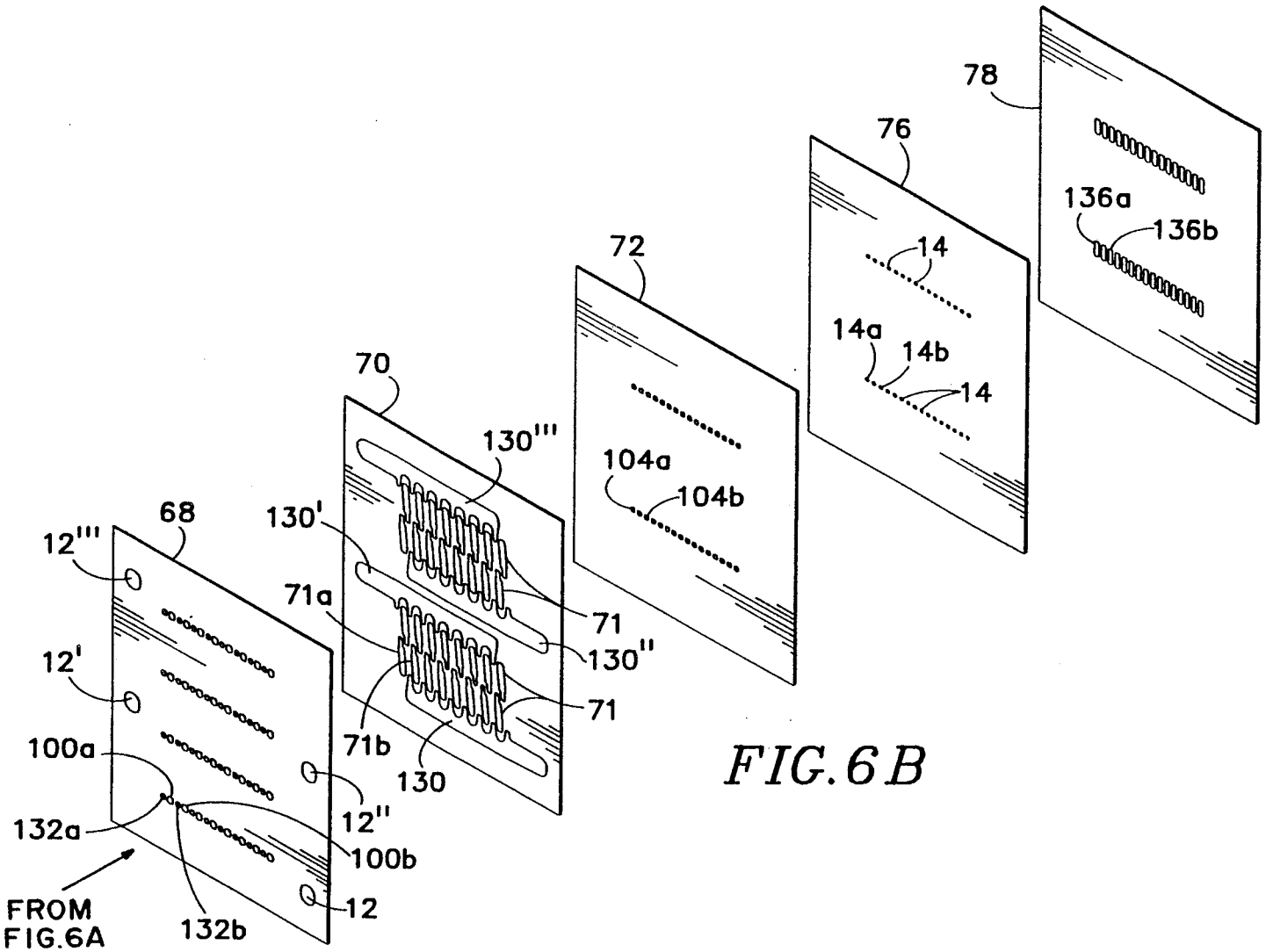

The inlet and outlet manifolds are preferably situated outside of the boundaries of the four rows of pressure chambers. In addition, the cross sectional dimensions of the inlet and outlet manifolds are optimized to contain the smallest volume of ink and yet supply sufficient ink to the jets when all of the ink jets are simultaneously operating and to provide sufficient compliance to minimize jet-to-jet interactions. Typical cross sectional dimensions are 0.12 by 0.02 inch. If the outlet channels and outlet manifolds are eliminated, then the ink jet print head of the present invention can be made even more compact by placing the inlet manifolds between the outer rows of pressure chambers and the nozzles and in the same layer as the offset channels 71. This can be done as shown in FIGS. 4 and 5. A further advantage to this latter construction is that the inlet channels 18 to both the inner and outer rows of pressure chambers may then have the same configuration and yet be of the same cross section and length. When the outlet channels are omitted, layer 72 is preferably retained to provide additional support to the thin nozzle layer. When the inlet manifolds are placed entirely beneath the outer rows of pressure chambers, then more rows of pressure chambers can be placed on an extension of the same hexagonal grid as the first four rows of pressure chambers. That is, a greater number of pressure chambers may be included in the layer 62. FIG. 6 illustrates this aspect of the invention in greater detail. In addition, FIGS. 9 through 18 illustrate manifolding and channel alignments of selected layers suitable for use in an ink jet print head of the type illustrated in FIG. 8.

Although plural ink supply channels are supplied with ink from each manifold, acoustic isolation between the ink chambers coupled to a common manifold is achieved in the present design. That is, with the above described construction, the ink supply manifolds and ink supply channels in effect function as a acoustic R-C circuits to dampen pressure pulses. These pressure pulses otherwise could travel back through the inlet channel from the pressure chamber in which they were originated, pass into the common manifold, and then into adjacent inlet channels and adversely affect the performance of adjacent jets. In the present invention, the manifolds provide compliance and the inlet channels provide acoustic resistance such that the pressure chambers are acoustically isolated from one another. By acoustic isolation it is meant that no effect on the ink drop ejection characteristics of one jet, due to the operation of any other jet or jets connected to the same manifold, has been observed to be no greater than ten microseconds and typically no more than three microseconds over the entire range of drop ejection rates. This amount of cross-talk has no visible effect on the resulting print.

To more clearly trace the flow path of ink through an ink jet print head of the invention, and with reference to FIGS. 2 and 3, ink is delivered through an ink inlet 12 (layer 60) and into an ink manifold 130 (layers 62, 64). Ink from manifold 130 is delivered to an inlet **132*a* of one of the inlet channels 102*a* (layer 66) and from inlet channel 102*a* through a pressure chamber inlet 20*a* (layers 66, 64) and to a pressure chamber 22*a* (layer 62). From pressure chamber 22*a*, in response to drop ejection pulses or during purging, ink flows through a connecting passageway 100*a* (layers 64, 66, 68), offset channel 71*a* (layer 70), passageway 104*a* (layers 72, 74) and to a nozzle 14*a* (layer 76). The guard plate 78 has an opening 136*a* which is larger than, but aligned with, nozzle 14*a*. During purging, the majority of the ink reaching passageway 104*a* is diverted away from the nozzle by way of a purging channel 42*a* to a passage 138*a* (layers 74, 72), which may be enlarged as shown in FIG. 1, to a purging manifold 44. From purging manifold 44, ink exits by way of a purging outlet 46 (layers 68-60). Similarly, ink flows from manifold 130 to a manifold inlet 132*b* (layer 66) of one of the inlet channels 102*b* and from inlet channel 102*b* through a pressure chamber inlet 20*b* (layers 66, 64) and to a pressure chamber 22*b*. From pressure chamber 22*b*, ink flows through a connecting passageway 100*b* (layers 64, 66, 68), offset channel 71*b* (layer 70), passageway 104*b* (layers 72, 74) and to a nozzle 14*b* (layer 76). The guard plate 78 has an opening 136*b* through which ink drops are ejected from nozzle 14*b*. During purging, the majority of ink reaching passageway 104*b* is diverted by way of a purging channel 42*b* to a passage 138*b* (layers 74, 72) and then to the purging manifold 44. From the manifold 44, ink flows from the ink jet print head through purging outlet 46** as previously explained.

In the illustrated FIG. 2 ink jet print head, there are upper and lower ink supply manifolds 130, 130′ and upper and lower ink purging manifolds 44, 44′. The flow paths to the remaining nozzles will be readily apparent from the above description. The FIG. 2 ink jet print head is typically used for printing black ink only. However, the ink jet print head may be used with two colors of ink, with one color being supplied to the upper manifold 130′ in FIG. 2 and the color to the lower manifold 130.

In the same manner, the flow path of ink through the ink jet print head of FIGS. 4 and 5 will be traced. For convenience, elements in these figures which are in common with those of FIG. 2 have been assigned like numbers. With reference to FIGS. 4 and 5, ink is delivered through an ink inlet 12 (layers 60, 62, 64, 66 and 68) to a manifold 130 in layer 70. A similar inlet 12′ extends through these layers to an upper ink manifold 130′. Ink from manifold 130 is delivered through a passageway **132*a* (layers 66, 68) to one end of an ink inlet channel 102*a*. Ink flows from channel 102*a* by way of a passage 20*a* (layers 66, 64) to an ink inlet at a lower end of pressure chamber 22*a*. From the upper end of pressure chamber 22*a*, ink passes through a passageway 100*a* (layers 64, 66 and 68) to a lower end of an offset channel 71*a* in layer 70. From the upper end of this offset channel, ink passes through a passageway 104*a* (layer 72) to the nozzle 14*a* (layer 76). The guard plate layer 78 includes an opening 136*a* which surrounds and is aligned with the orifice or nozzle 14*a***.

The flow path of ink to ink pressure chamber **22*b* and from this ink pressure chamber to its associated nozzle 14*b* is similar to the above described flow path. Therefore, the components of this ink flow path are identified with a corresponding number together with the subscript b, and will not be discussed further. Like the ink jet print head of FIG. 2, the FIG. 4 version of ink jet print head may be used for a single color of ink (for example, black) or for two colors of ink. In addition, as previously mentioned, the FIG. 4** version of the ink jet print head eliminates the purging manifolds and purging channels.

FIG. 6 illustrates the ready expansion of the ink jet print head design of the present invention to include more manifolds for more colors and yet preserve the close spacing of the ink jet print chambers 22 and of the nozzles 14. The nozzles of the ink jet print head of FIG. 6 are aligned in two horizontal rows.

Each of the manifolds 130, 130', 130'' and 130''' (layer 30) may be supplied via respective inlets 12, 12', 12'' and 12''' with respective colors of ink, such as black, cyan, yellow and magenta in any order. The detailed flow path of ink to the various pressure chambers need not be discussed as it is similar to the flow path described above in connection with FIG. 4. However, for purposes of further illustration, the ink flow path components for pressure chambers 22*a* and 22*b* are numbered with numbers which correspond to the numbering in FIG. 4.

Figure 8A:
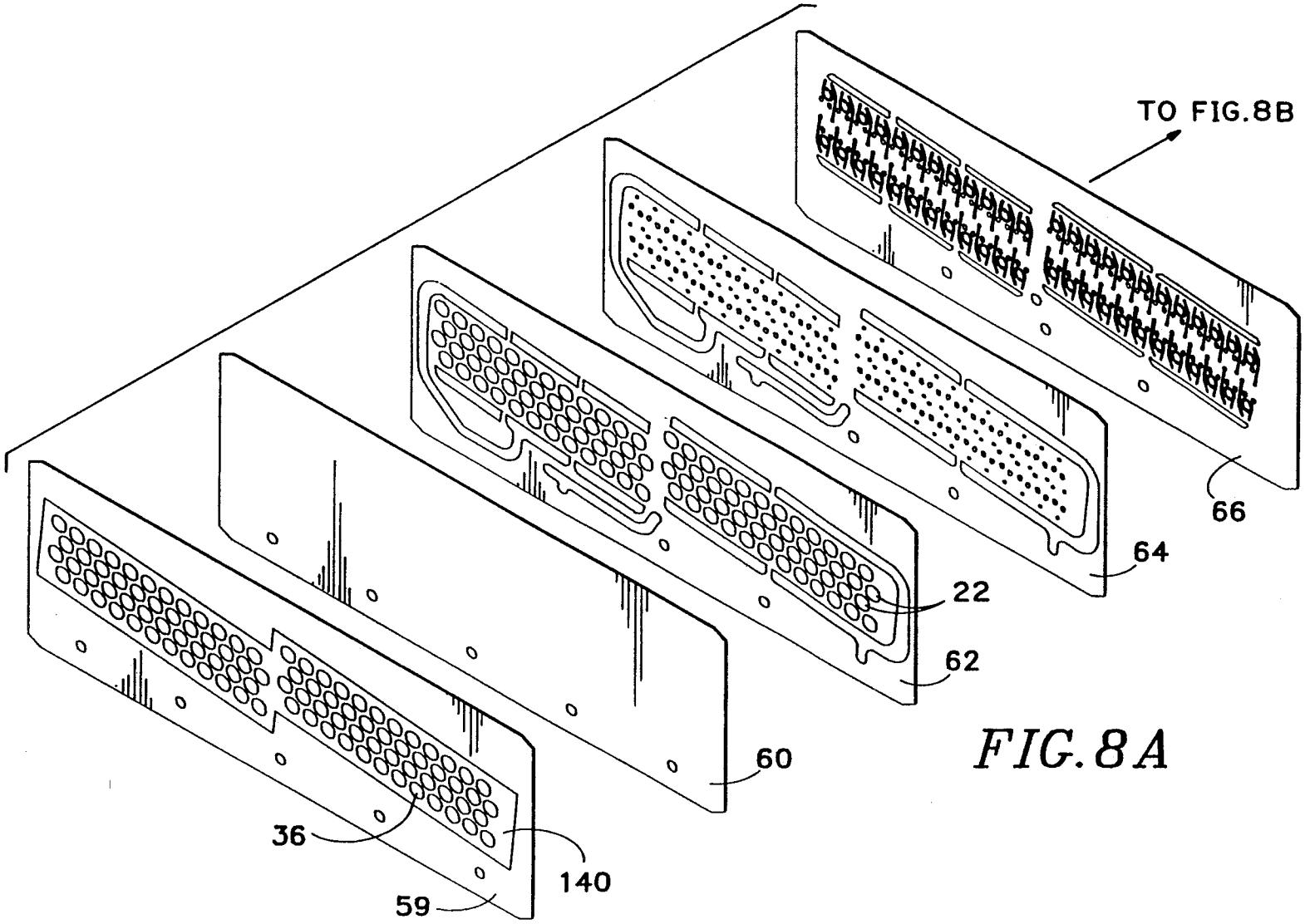
FIGS. 8A and 8B are an exploded perspective view of the various layers of an ink jet print head array in accordance with another embodiment of the present invention having ninety-six nozzles in the array.
Figure 8B:
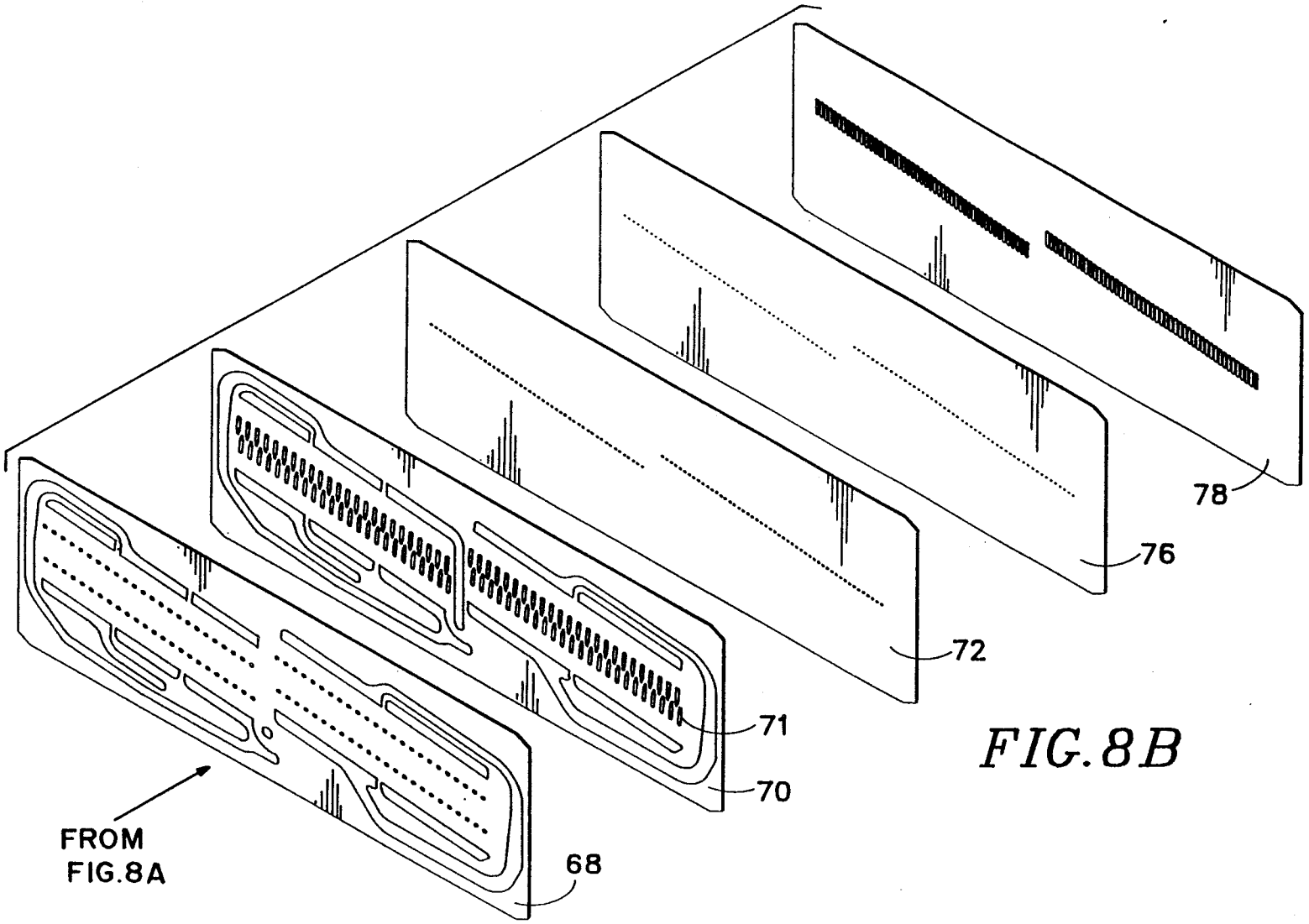

The ink jet print head of FIG. 8 has been used on a typewriter-like shuttle printing mechanism to make full color prints at an addressability of 300 dots per inch both horizontally and vertically. This print head has been operated consistently and reliably at all repetition rates up to about 11,000 drops per second per nozzle with the outer limits of operation yet to be determined. The FIG. 8 ink jet print head has a row of 48 nozzles that are used to print black ink. This ink jet print head also has a separate, horizontally offset, row of 48 nozzles that are used to print colored ink. Sixteen of these latter nozzles are used for cyan ink, sixteen for magenta ink, and 16 for yellow ink.

The ink jet print head layout of FIG. 8 can be readily modified to have nozzles on a single line rather than a dual line. None of the operating characteristics of the ink jet print head would be affected by this modification.

FIGS. 9 through 18 illustrate respectively a transducer receiving spacer plate 59, the diaphragm plate 60, the ink pressure chamber plate 62, separator plate 64, ink inlet plate 66, separator plate 68, offset channel defining plate 70, separator plate 72, nozzle or orifice plate 76 and guard plate 78 for the 96 nozzle ink jet print head of FIG. 8. The FIG. 8 ink jet print head is designed with multiple ink receiving manifolds which are capable of receiving various colors of ink. The illustrated embodiment has five sets of manifolds, each set including two manifold sections. The sets of manifolds are isolated from one another such that the ink jet print head can receive five distinct colors of ink. Thus, for example, the ink jet print head can receive cyan, yellow and magenta inks for use in full subtractive color printing together with black ink for printing text. A fifth color of ink could also be used instead of obtaining this fifth color by combining cyan, yellow and magenta inks on the print medium. Also, because black ink is typically used to a greater extent than colored ink in applications in which both text and graphics are being printed, more than one set of manifolds may be supplied with black ink. This latter application is the specific example that will be described below. In addition, by including plural manifold sections for each color of ink, the distance between individual manifold sections and an associated nozzle supplied with ink by the manifold section is minimized. This minimizes dynamic ink pressures arising from accelerating and decelerating quantities of ink as an ink jet print head shuttles, for example, along a horizontal line during printing.

To more clearly describe the FIG. 8 embodiment of the present invention, ink flow paths through the various layers making up this embodiment will be described with reference to FIGS. 9–18.

Figure 9:
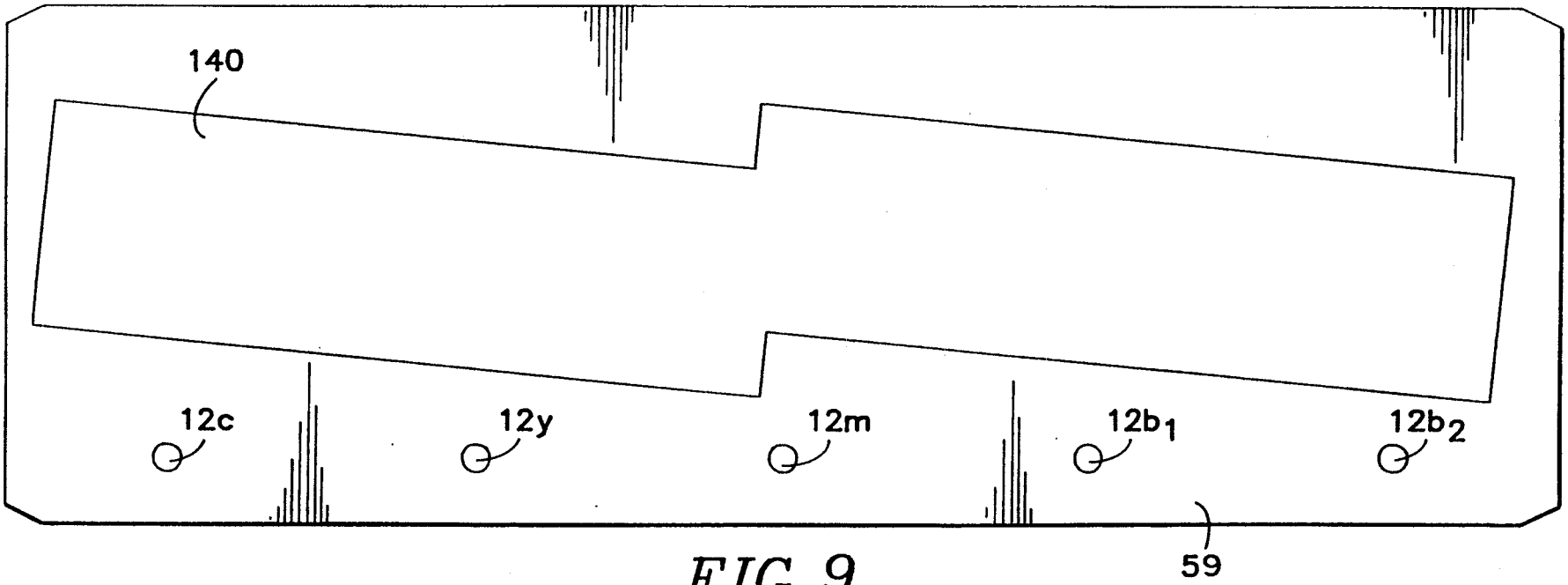
FIGS. 9–18 are top plan views of various layers forming an array ink jet of the type illustrated in FIG. 8.

With reference to FIG. 9, a spacer plate 59 is shown with an opening 140 within which the piezoceramic transducers 36 (FIG. 8) are positioned. Spacer plate 59 is optional and provides a flat surface at the rear of the ink jet print head that is co-planar with the outer surface of the piezocermaic crystals. Plural ink supply inlets are provided through layer 59 through which ink is delivered to the ink jet print head. These inlets are designated 12*c* (the c referring to cyan as this is the cyan color ink supply inlet), 12*y* (the y referring to yellow as this is the yellow color ink input), 12*m* (the m referring to magenta as this is the magenta color ink input), 12$b_1$ (the $b_1$ referring to a first black ink inlet), and 12$b_2$ ($b_2$ referring to a second black ink inlet). For convenience, throughout the following description the letter c will be used in conjunction with cyan ink flow path components, the letter y will be used in conjunction with yellow ink flow path components, the letter m will be used in conjunction with magenta ink flow path components, the designation $b_1$ will be used in conjunction with flow path components supplied through the first black ink inlet, and the designation $b_2$ will be used in conjunction with flow path components supplied through the second black ink inlet. It should be noted that the various colors need not be delivered to the ink jet print head in the recited order. However, as explained below, the illustrated ink jet print head has 48 nozzles for printing colored ink at the left-hand section of the FIGS. 8–18 ink jet print head and 48 nozzles are for printing black ink at the right-hand portion of the ink jet print head.

Figure 10:
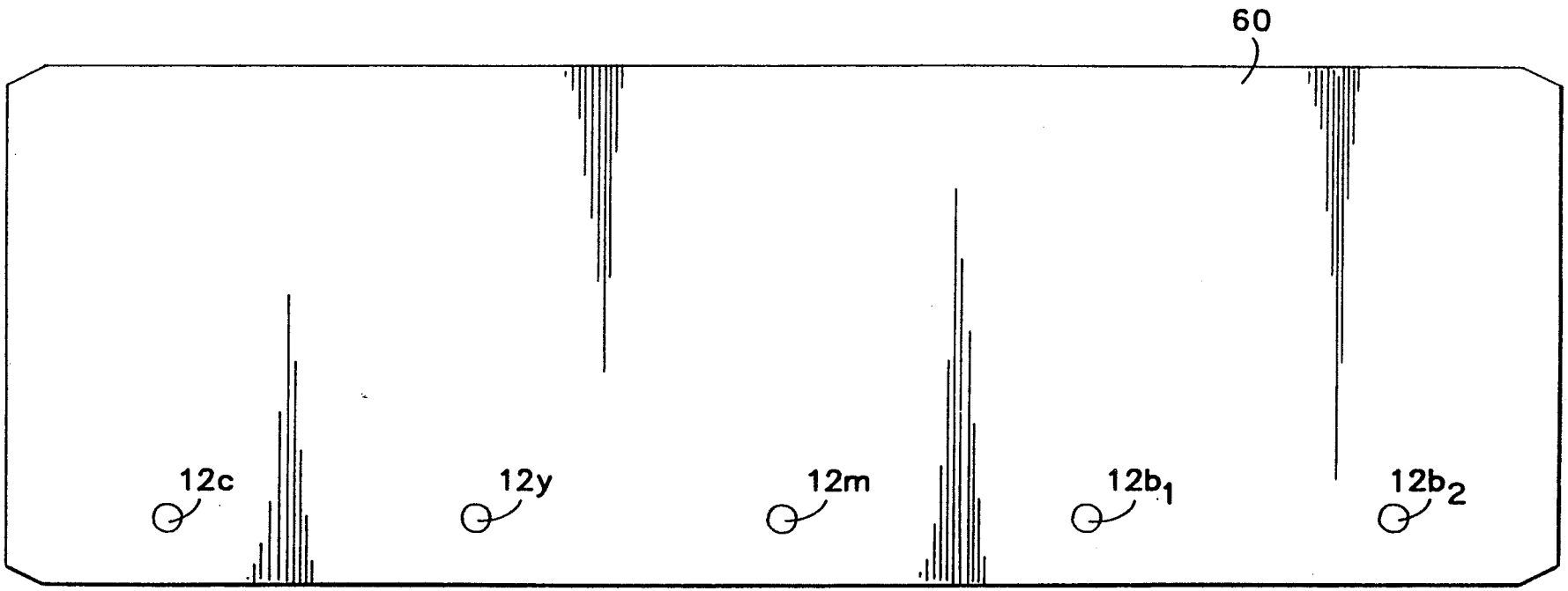

Referring to the diaphragm layer 60 in FIG. 10, the respective ink inlets 12*c* through 12$b_2$ also extend through this layer.

Figure 11:
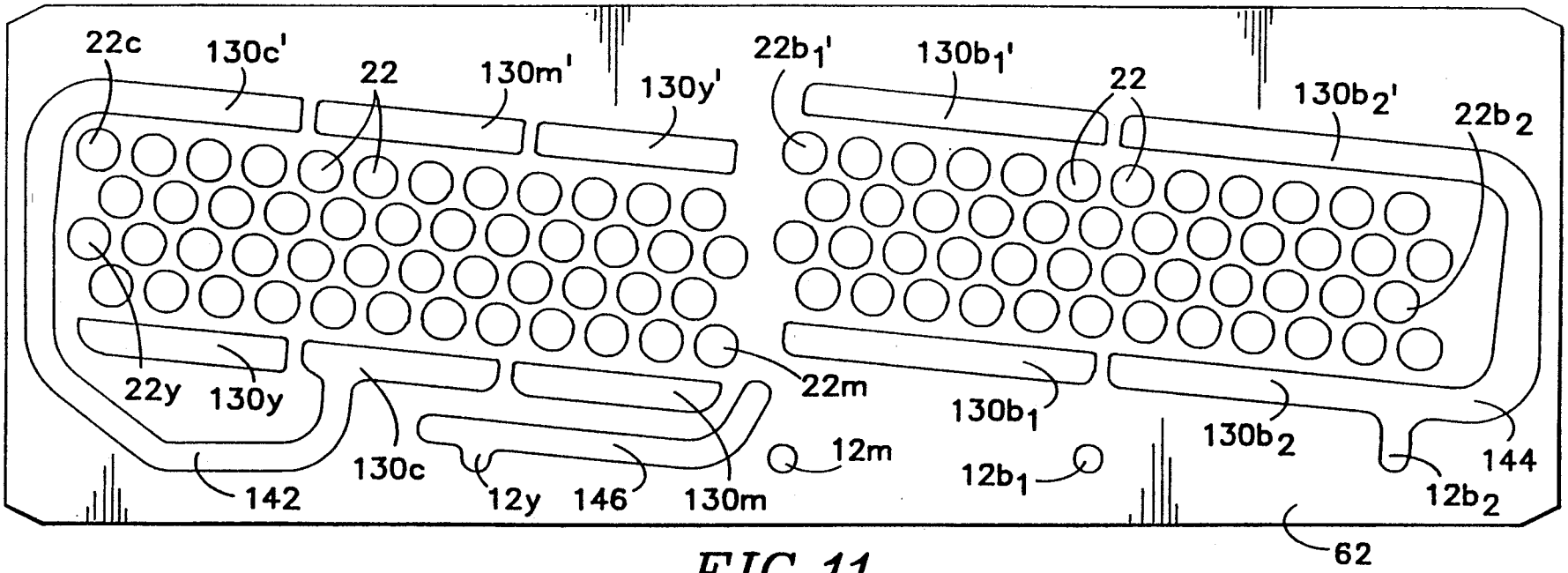

With reference to FIG. 11, the cyan inlet 12*c* is coupled to a cyan ink supply channel 142 in this layer that communicates with two cyan manifold sections 130*c*, 130*c'*. The manifold section 130*c* is located outside of the left hand array of pressure transducers 22 and adjacent to the lower middle portion of this array. The manifold section 130*c'* is located adjacent to the upper left-hand portion of this pressure chamber array. In addition, in layer 62 the ink inlet 12$b_2$ communicates with a channel 144 coupled to respective black ink manifold sections 130$b_2$ and 130$b_2'$. Manifold section 130$b_2$ is located adjacent to the lower right-hand portion of the right-most array of ink jet pressure chambers 22 and the manifold section 130$b_2'$ is located along the upper right-hand section of this pressure chamber array.

The yellow ink inlet 12*y* is also connected to a communication channel 146 in layer 62, although the coupling of the yellow ink to yellow ink manifold section 130*y* and 130*y'* (FIG. 11) takes place in another layer. Also, the magenta ink supply inlet 12*m* and first black ink supply inlet 12$b_1$ pass through layer 62. These inlets are coupled to respective magenta and black ink manifolds, portions of which are shown as 130*m*, 130*m'*, 130$b_1$ and 130$b_1'$ in FIG. 62, in other layers of the ink jet print head. By including communication channels, such as 142, 144 and 146 in the ink jet print head between separated manifold sections only 5 rather than 10 ink supply ports are required. In addition, by including the manifolds in more than one layer, the depth and thus the volume of the manifolds is increased to thereby increase their acoustic compliance.

Figure 12:
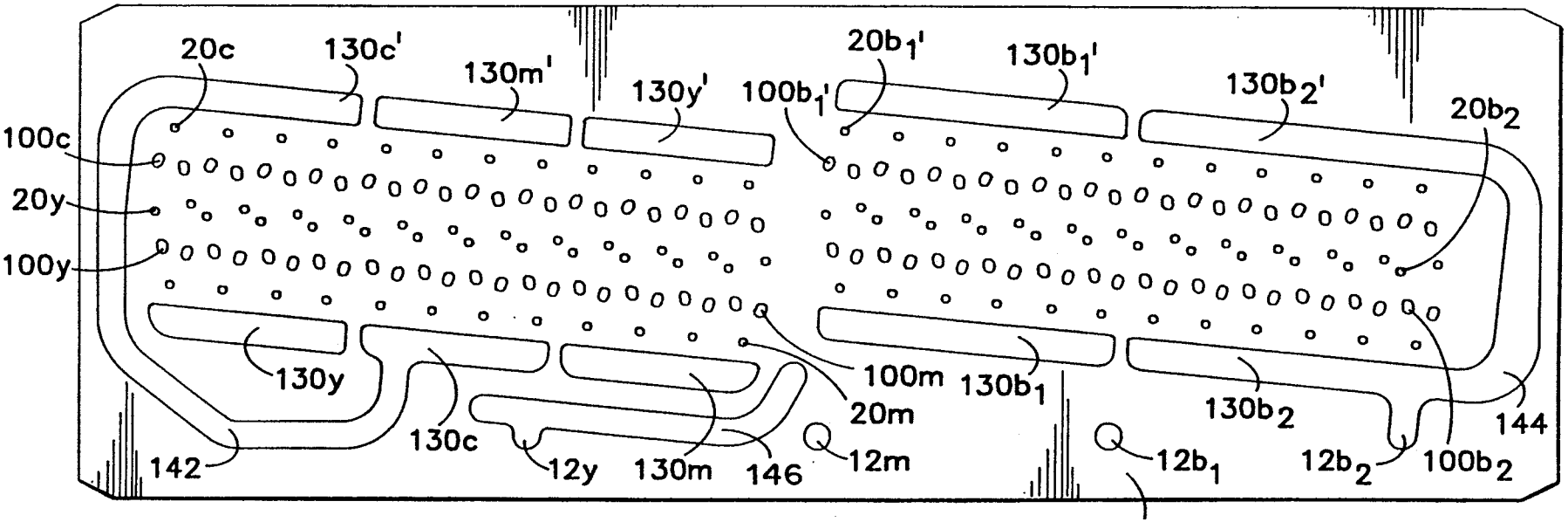

As can be seen from FIG. 12, the manifolds and communication channels of layer 62 are aligned with similar manifolds and communication channels of layer 64. Similarly, with reference to FIG. 13 and layer 66, portions of the ink supply manifolds are included in this layer for added acoustic compliance. Also, layer 66 shows passageways 12g and 12y'. These latter passageways communicate with the ends of the communication channel 146 in the layers 11 and 12. Also, for added volume and acoustic compliance, portions of the respective manifolds are defined by layer 66.

Figure 14:
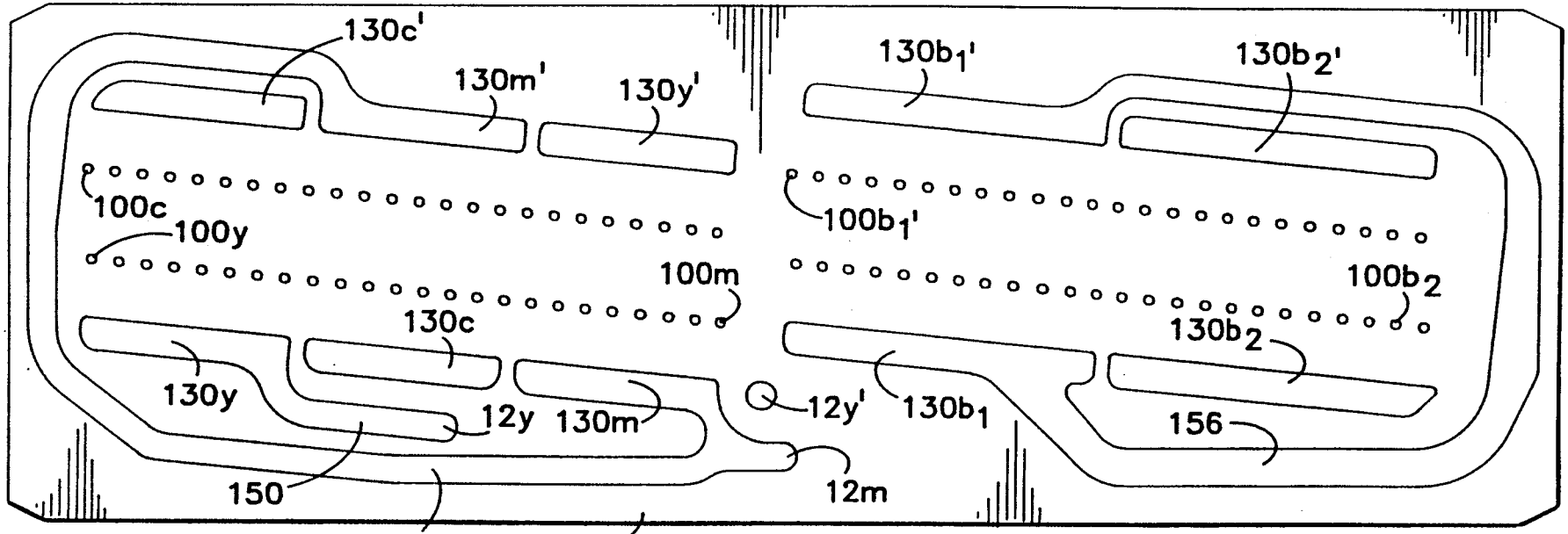
Figure 15:
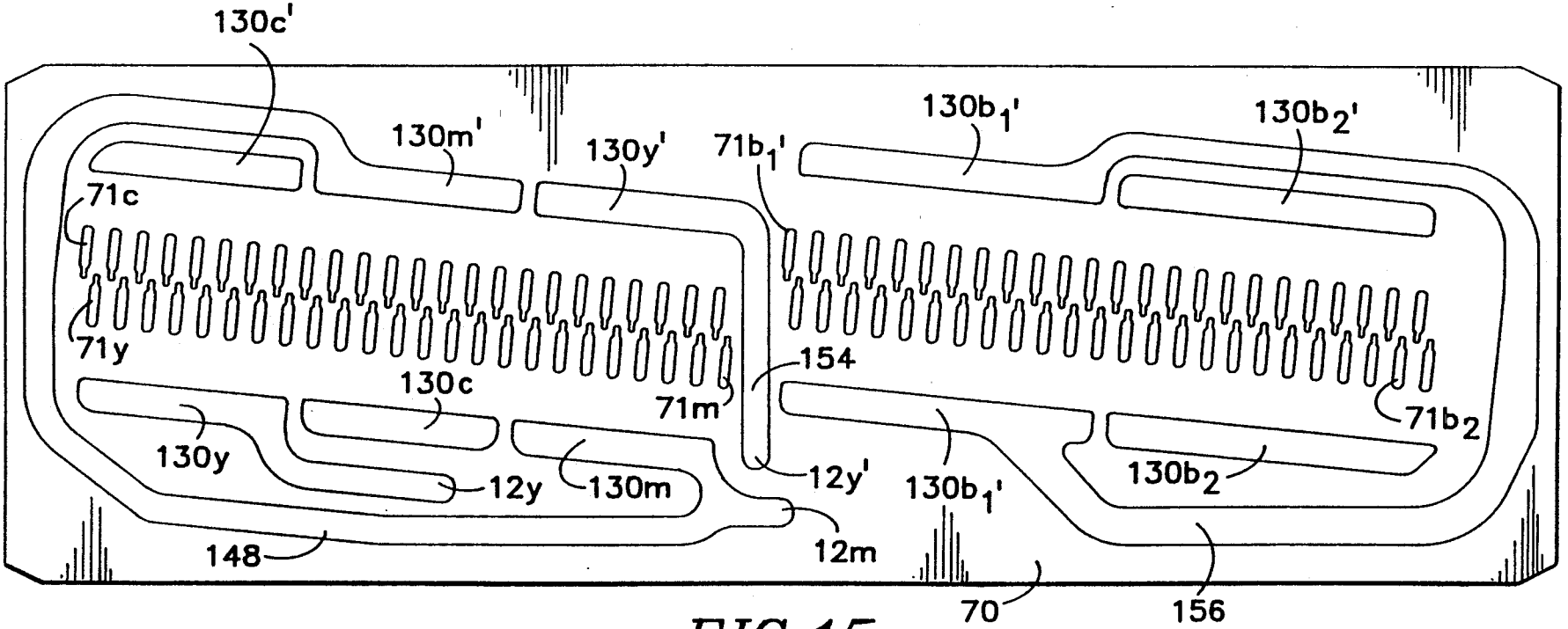
Figure 16:
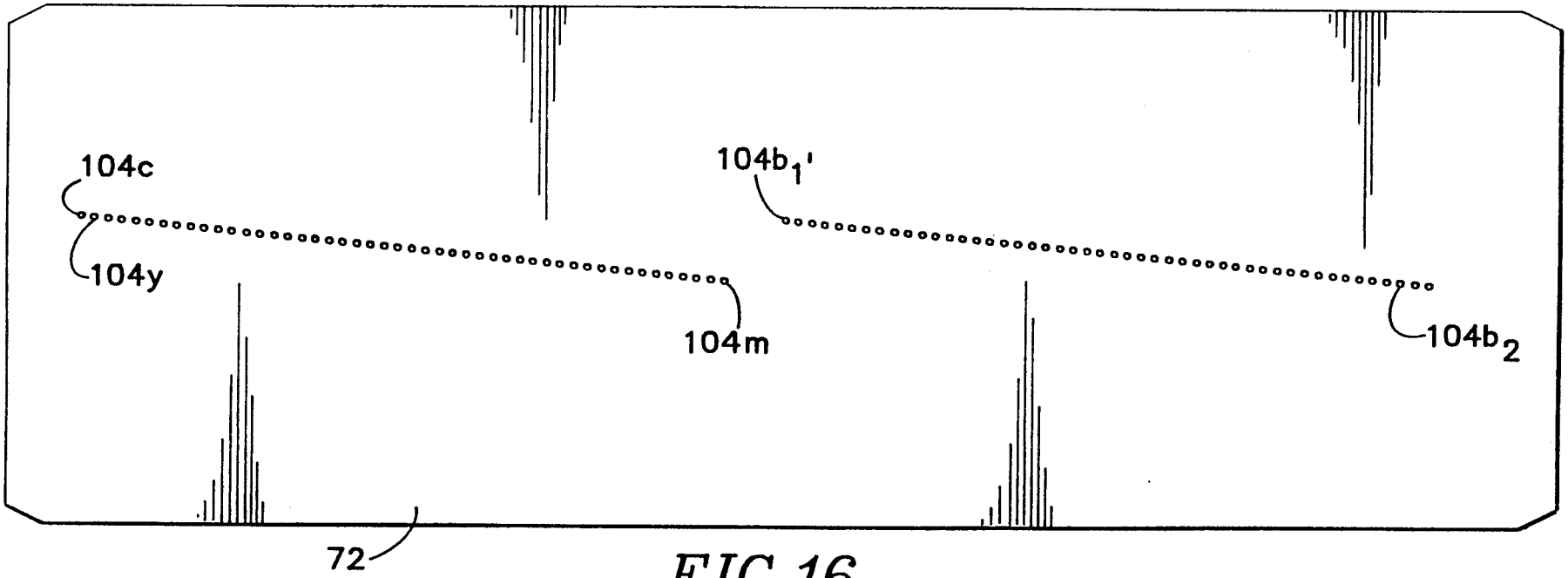

With reference to FIGS. 14 and 15, the magenta inlet passage 12m is coupled to a communication channel 148 and by way of this channel to the magenta manifold sections 130m and 130m'. In addition, the yellow ink supply inlet 12y is coupled by a channel 150 to the manifold section 130y (FIG. 14). Furthermore, the yellow inlet channel 12y' is coupled by a communication channel 154 (FIG. 15) to the yellow ink manifold section 130y'. In addition, the black ink supply inlet $12b_1$ communicates with a passageway 156 in layers 68, 70 (FIGS. 14 and 15) and by way of this passageway 156 to the black ink manifold sections $130b_1$ and $130b_1'$.

Therefore, in the above manner each of the ink manifold sections is supplied with ink. Also, the volume of the individual manifold sections is increased by including portions of the manifold sections in multiple layers.

For purposes of further illustration, delivery of ink from these manifolds to selected black, cyan, magenta and yellow ink pressure chambers $22b_1$, $22b_2$, 22c, 22m and 22y (FIG. 11) will be described. Also, the flow of ink from these ink pressure chambers to their associated respective nozzles will be described. From this description, the flow path of ink to the other pressure chambers and nozzles will be readily apparent.

Figure 13:
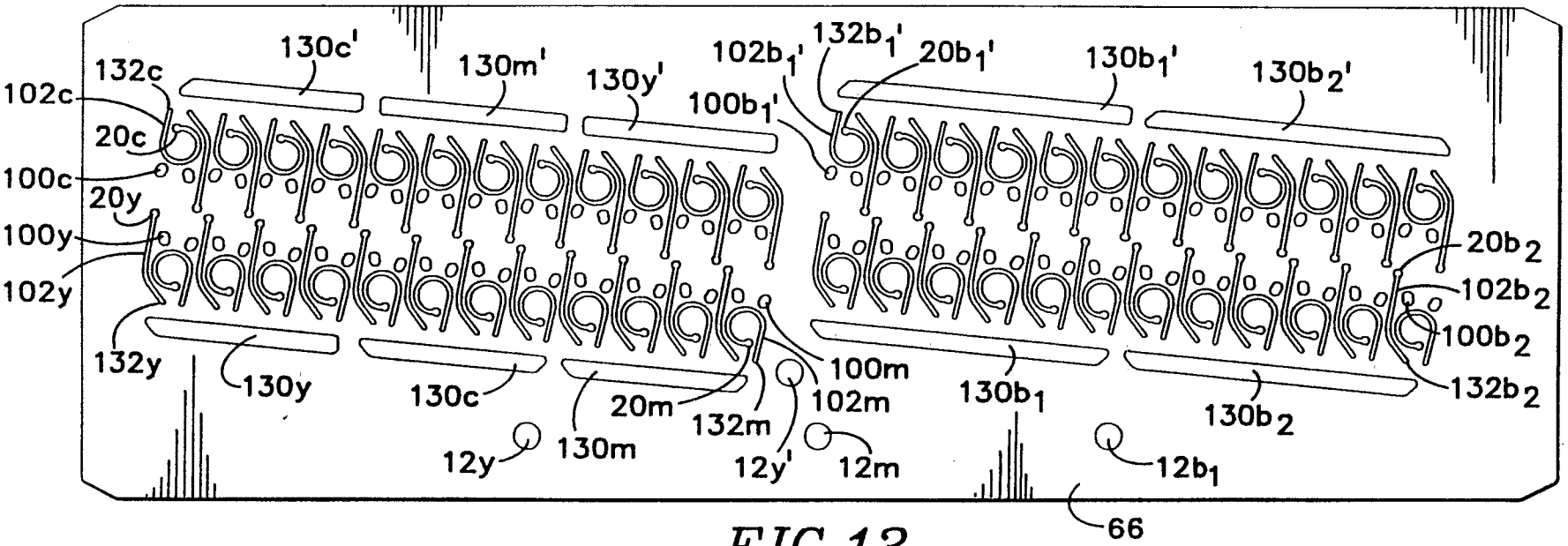

With reference to FIGS. 13 and 14, ink from cyan manifold section 130c' flows into an ink inlet 132c of an ink supply channel 102c. Ink flows from channel 102c through an ink pressure chamber supply inlet 20c (layers 66, 64 in FIGS. 13 and 12) and into the upper portion of the ink pressure chamber 22c (layer 62, FIG. 11). Ink passes across the ink pressure chamber 22c, exits from this chamber by way of a passageway 100c (layers 64, 66 and 68, FIGS. 12, 13 and 14) and flows to the upper end of an offset channel 71c (layer 70, FIG. 15). From the lower end of the offset channel 71c, ink flows through an opening 104c (layer 72, FIG. 16) to an associated nozzle 14c (layer 76, FIG. 17). The nozzle 14c is aligned with an opening 136c in an overlying guard layer 78 (FIG. 18).

In the same manner, ink from yellow ink manifold section 130y (FIG. 14) enters an inlet 132y (FIG. 13) of an ink supply channel 102y. From ink supply channel 102y, ink flows through a passageway 20y (layers 66 and 64, FIGS. 13 and 12) to the upper portion of the ink pressure chamber 22y. From the lower portion of the ink pressure chamber, ink flows through a passageway 100y (layers 64, 66 and 68, FIGS. 12, 13 and 14) to the lower end of an offset channel 71y (layer 70, FIG. 15). From the upper end of this offset channel, ink flows through an opening 104y (layer 72, FIG. 16) and to a nozzle 14y (layer 76, FIG. 17). An opening 136y in the guard layer 78 (FIG. 18) overlays the nozzle opening 14y. In the same manner, the ink supply to and from the pressure chambers 22m, $22b_1$ and $22b_2$ are indicated with numbers corresponding to the numbers used above and with the respective subscripts m, $b_1$ and $b_2$.

Figure 17:
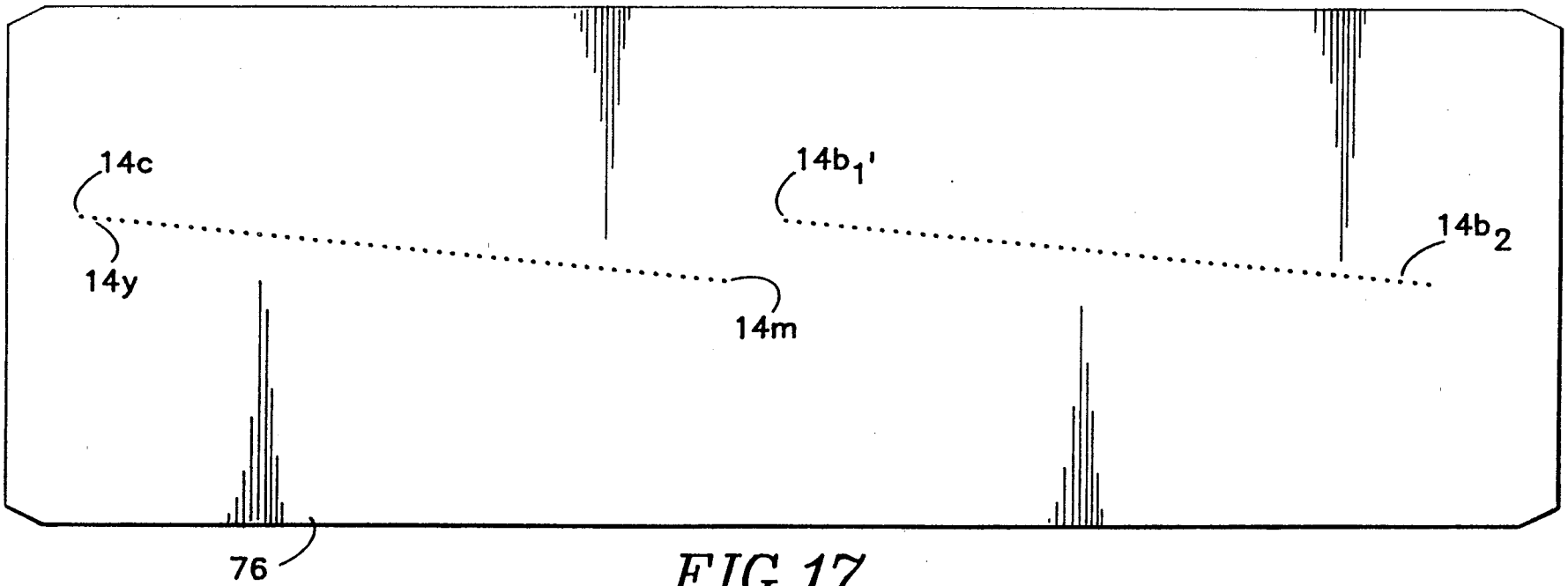
Figure 18:
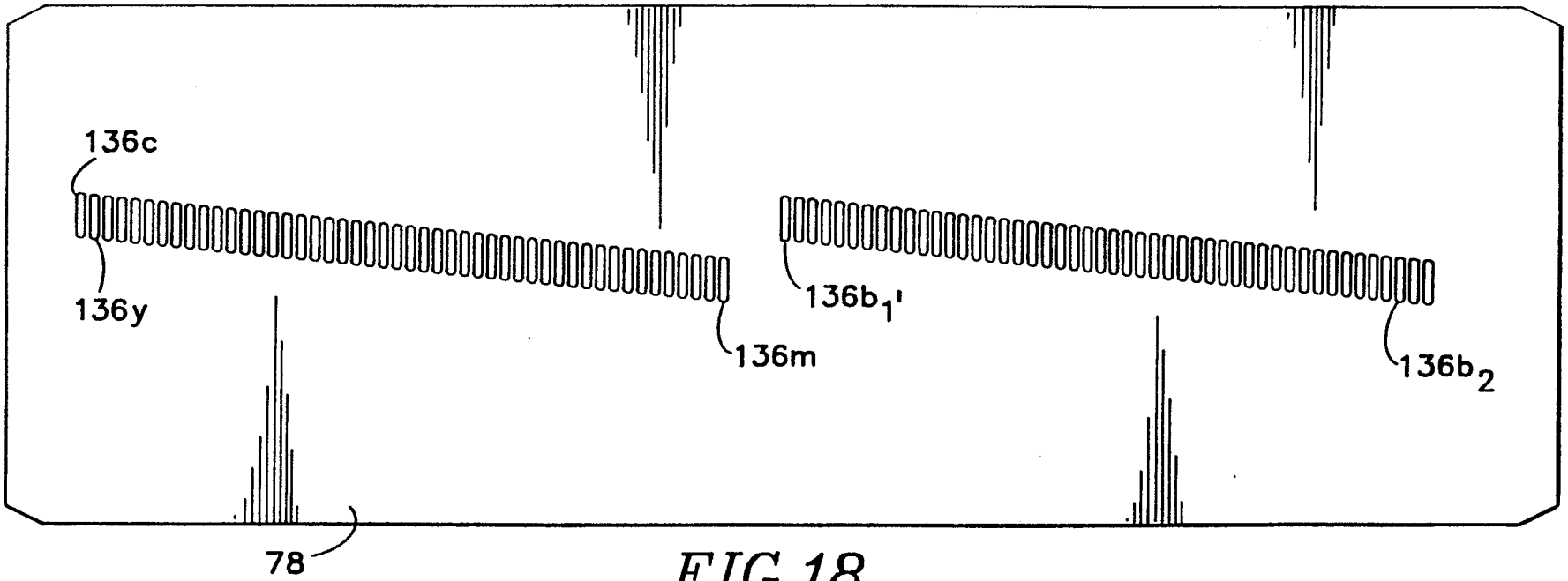

Referring to FIGS. 8, 15 and 17, with the manifolding arrangement described above, the 48 offset channels in the right-hand array of FIG. 15 are supplied with black ink along with the 48 nozzles in FIG. 17 which are included in the right-hand row of nozzles of the orifice plate 76. In addition, the first eight offset channels of the upper row of offset channels in the left-hand offset channel array of FIG. 15 are supplied with cyan ink, the next eight offset channels in this row are supplied with magenta ink, and the third group of eight offset channels in this row are supplied with yellow ink. In addition, the first eight offset channels in the lower row of this left-hand offset channel array are supplied with yellow ink, the next eight offset channels of this lower row are supplied with cyan ink, and the last group of eight offset channels of this lower row are supplied with magenta ink. Because of the interleaved nature of the upper ends of the lower offset channels and the lower ends of the upper offset channels of FIG. 15, the nozzles of the ink jet print head of this construction (see FIG. 17) are supplied with interleaved colors of ink. That is, adjacent nozzles in the left-hand row of nozzles in FIG. 17 are each supplied with a different color of ink. This facilitates color printing as the vertical spacing between nozzles of a given color of ink is at least two addresses apart. The manifolding and ink supply arrangements can be easily modified to alter the interleaved arrangement of nozzle colors as desired.

Therefore, FIG. 8 illustrates a compact, easily manufacturable and advantageous ink jet print head of the present invention.

Having illustrated and described the principles of our invention with reference to several preferred embodiments, it should be apparent to those with ordinary skill in the art that such invention may be modified in arrangement and detail without departing from such principles. We claim as our invention all such modifications as come within the true spirit and scope of the following claims.

We claim:

1. A multiple-nozzle drop-on-demand ink jet print head for receiving ink from an ink supply and for ejecting ink drops toward a print medium in response to an acoustic driver coupled to each nozzle, the ink jet print head comprising:

a plurality of plates held together to form the ink jet print head;

a first of such plates including therein at least one row of nozzles through which ink drops are ejected;

a second of such plates defining a plurality of generally circular ink pressure chambers each of which having a geometric center and being arranged with its geometric center positioned in one of at least three nonintersecting rows, the geometric centers of the ink pressure chambers in one row being staggered from those in adjacent ones of the other rows, and each of the ink pressure chambers having an ink inlet connected to an ink supply channel and having an ink outlet connected to a passageway, the ink inlets and ink outlets being spaced oppositely across the ink pressure chambers from one another for drawing ink from the ink supply channel and directing ink through a passageway toward an associated one of the nozzles in the first plate;

the first and second plates also separated by at least one passageway-defining plate having passageways of substantially equal lengths and cross-sectional areas for connecting each of the nozzles with an associated one of the ink outlets; and a third of such plates positioned contiguous with the second plate and including acoustic drivers coupled to each of the ink pressure chambers, whereby the nozzles have similar resonance characteristics and exhibit substantially identical jetting characteristics when the acoustic drivers associated with their respective nozzles are driven with substantially identical waveforms.

2. A drop-on-demand ink jet head according to claim 1 in which each of the passages has an offset channel portion with a longitudinal axis extending in a direction generally parallel to the plane of the second plate.

3. A drop-on-demand ink jet according to claim 1 in which the non-intersecting rows of ink pressure chambers comprise parallel rows.

4. A drop-on-demand ink jet print head according to claim 1 in which all of the ink pressure chambers of the ink jet print head are in a common plane.

5. A drop-on-demand ink jet print head according to claim 1 in which each of the nonintersecting rows of ink pressure chambers has at least four of the ink pressure chambers arranged in an array and in which the ink pressure chambers have geometric centers arranged in a hexagonal grid.

6. A drop-on-demand ink jet head according to claim 1 in which the plates define at least one ink supply manifold and plural ink supply channels each coupling the ink supply manifold to an ink inlet of a respective ink pressure chamber, the entire lengths of the ink supply channels being of substantially equal lengths and cross-sectional areas, the ink supply channel and manifold being sized to provide acoustic damping of pressure pulses from ink pressure chambers to reduce acoustic cross talk between the ink pressure chambers while providing sufficient ink for ink jet operation at the highest ink drop ejection rate.

7. A multiple-nozzle drop-on-demand ink jet print head for receiving ink from an ink supply and for ejecting ink drops toward a print medium in response to an acoustic driver coupled to each nozzle, the ink jet print head comprising:

a body defining at least one row of nozzles through which ink drops are ejected;

the body defining at least three rows of generally circular ink pressure chambers with at least three ink pressure chambers in each row, each of the ink pressure chambers having an ink inlet for receiving ink from the ink supply and an ink outlet for directing ink toward each nozzle;

the body defining plural passages of substantially equal lengths and cross-sectional areas each of the passages coupling the ink outlet of an associated ink pressure chamber to an associated nozzle, and each of the nozzles having a central axis extending normal to the plane of the associated ink pressure chamber and intersecting the plane of the associated ink pressure chamber at a location offset from the associated ink pressure chamber; and acoustic drivers mounted to the body and coupled to each of the ink pressure chambers, whereby the nozzles have similar resonance characteristics and exhibit substantially identical jetting characteristics when the acoustic drivers associated with their respective nozzles are driven with substantially identical waveforms.

8. A drop-on-demand ink jet print head according to claim 7 in which the ink pressure chambers are generally co-planar and each of the ink pressure chambers has a geometric center, the geometric centers of the ink pressure chambers in one row being staggered from those adjacent ones of the other rows.

9. A drop-on-demand ink jet head according to claim 7 in which the nonintersecting rows of ink pressure chambers comprise parallel rows.

10. A drop-on-demand ink jet print head according to claim 7 in which the body defines at least one ink supply manifold and plural ink supply channels each coupling the ink supply manifold to an ink inlet of a respective ink pressure chamber, each of the ink supply channels being of substantially equal length and cross-sectional area, and the ink supply channels and manifold are sized to provide acoustic isolation of the ink pressure chambers coupled to the manifold.

* * * * *